US011782367B1

(12) United States Patent
Ota

(10) Patent No.: US 11,782,367 B1
(45) Date of Patent: Oct. 10, 2023

(54) IMAGE FORMING APPARATUS HAVING WEIGHTED AVERAGE CONTROL WITH ESTIMATED TEMPERATURE CONTROL FUNCTION

(71) Applicant: TOSHIBA TEC KABUSHIKI KAISHA, Tokyo (JP)

(72) Inventor: Hiroshi Ota, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/895,964

(22) Filed: Aug. 25, 2022

(51) Int. Cl.
*G03G 15/20* (2006.01)
*G03G 15/00* (2006.01)

(52) U.S. Cl.
CPC ..... *G03G 15/2039* (2013.01); *G03G 15/2064* (2013.01); *G03G 15/5004* (2013.01); *G03G 2215/2038* (2013.01)

(58) Field of Classification Search
None
See application file for complete search history.

(56) References Cited

U.S. PATENT DOCUMENTS 6,163,662 A * 12/2000 Martin ..... G03G 15/5029 399/45
9,715,197 B2 * 7/2017 Seshita ..... G03G 15/205
11,281,134 B2 3/2022 Usami
11,630,405 B1 * 4/2023 Tanaka ..... G03G 15/205 399/69
2009/0279908 A1 * 11/2009 Yoneda ..... G03G 15/2039 399/33
2013/0022366 A1 * 1/2013 Ando ..... G03G 15/205 399/70
2020/0218183 A1 7/2020 Shibuya
2021/0364956 A1 * 11/2021 Usami ..... G05D 23/1919
2023/0145933 A1 * 5/2023 Usami ..... G03G 15/2064 399/328

FOREIGN PATENT DOCUMENTS

JP 2017167259 A 9/2017
JP 2020079881 A 5/2020

* cited by examiner

*Primary Examiner* — Sevan A Aydin
(74) *Attorney, Agent, or Firm* — Kim & Stewart LLP

(57) ABSTRACT

According to one embodiment, an image forming apparatus includes a fixer including a rotating body and a heating member to heat the rotating body. A temperature sensor is positioned to detect a temperature of the rotating body and output a temperature detection result. A heating control circuit is configured to estimate the temperature of the rotating body based on the temperature detection result, a power supply voltage value, an energization pulse setting for controlling the heating member, a heat capacity of the fixer, and a heat resistance of the fixer. The control circuit generates an energization pulse for controlling power supplied to the heating member based on the estimated temperature and the temperature detection result. A controller detects a variation in the heat capacity of the fixer device and supplies a correction amount for the heat capacity corresponding to the detected variation to the heating control circuit.

20 Claims, 11 Drawing Sheets

FIG. 2

25

MEMORY

| TEMPERATURE DIFFERENCE (°C) | CORRECTION AMOUNT |
|---|---|
| ⋮ | ⋮ |
| 10 | 5.3 |
| 9 | 4.8 |
| 8 | 4.3 |
| 7 | 3.7 |
| 6 | 3.2 |
| 5 | 2.7 |
| 4 | 2.1 |
| 3 | 1.6 |
| 2 | 0.0 |
| 1 | 0.0 |
| 0 | 0.0 |
| −1 | 0.0 |
| −2 | 0.0 |
| −3 | −1.6 |
| −4 | −2.1 |
| −5 | −2.7 |
| −6 | −3.2 |
| −7 | −3.7 |
| −8 | −4.3 |
| −9 | −4.8 |
| −10 | −5.3 |
| ⋮ | ⋮ |

251

252

| HEAT CAPACITY CORRECTION AMOUNT |
|---|
| 2.1 |

253

| ACQUISITION FLAG |
|---|
| 1 |

254

| ACQUISITION FLAG SET TIME |
|---|
| 2022.04.15 / 08:52:38 |

IMAGE FORMING APPARATUS HAVING WEIGHTED AVERAGE CONTROL WITH ESTIMATED TEMPERATURE CONTROL FUNCTION

FIELD

Embodiments described herein relate generally to an image forming apparatus having a weighted average control with estimated temperature (WAE) control function.

BACKGROUND

An image forming apparatus placed in a workplace includes a fixer (fixing device) that fixes a toner image to a print medium by applying heat and pressure to the print medium. The fixer includes a fixing rotating body (e.g., heated roller, belt, or the like), a pressing member (e.g., press roller or the like), a heating member (e.g., lamp, IH heater, or the like), and a temperature sensor. The temperature sensor detects a temperature at a surface of the fixing rotating body. A controller that controls the fixer thus controls a surface temperature of the fixing rotating body to be a target value by increasing or decreasing an amount of power supplied to the heating member based on a detection signal (temperature sensor signal) from the temperature sensor. A deviation (or a time lag) occurring between the temperature detected by the temperature sensor and the surface temperature of the fixing rotating body may cause overshoot, temperature ripple, or the like. In order to prevent the occurrence of overshoot, temperature ripple, or the like, a temperature sensor (for example, a thermopile) having excellent responsiveness is required. However, there is a problem that a temperature sensor having excellent responsiveness is typically expensive. Thus, less expensive temperature sensors, such as simple thermocouples or thermistors, may be adopted in practice even though slower responding to temperature changes/variation.

Therefore, an image forming apparatus having a weighted average control with estimated temperature (WAE) control function has been proposed. Movement of heat in the fixer can be expressed equivalently as a RC time constant of an electric circuit. That is, a heat capacity of the fixer is replaced with a capacitor C, and a resistance of heat transfer is replaced with a resistor R. A heat source can be replaced with a DC voltage source. Energization/interruption from the DC voltage source is repeated based on an energization pulse, a RC circuit operates in accordance with an input voltage pulse thereof to generate an output voltage, and the output voltage is applied to the heating member. An amount of heat propagated to the surface of the fixing rotating body to be controlled can be estimated based on the RC circuit in which a value of each element is set in advance based on the amount of power supplied to the heating member, a heat capacity of the fixing rotating body, and the like. By simulating such a thermal RC circuit, WAE control sets the surface temperature of the fixing rotating body to the target value by controlling the amount of power supplied to the heating member based on an actual surface temperature of the fixing rotating body as estimated from an input energy to the fixer and the like.

In an image forming apparatus including a power supply voltage detection device, since the actual input voltage (input energy) is known, a more accurate estimation (calculation) can be achieved in the WAE control.

The heat capacity (C) of the fixer used in the WAE control is set to a design standard value. Therefore, the estimated value of the surface temperature of the fixing rotating body may be deviated due to a variation in heat capacity of the fixer found in each image forming apparatus. In such a case, there is a problem that the surface temperature of the fixing rotating body cannot be controlled to be the target value.

BRIEF DESCRIPTION OF THE DRAWINGS

FIG. 2 is a diagram illustrating an example of storage contents in a non-volatile area of a memory.

DETAILED DESCRIPTION

In general, according to one embodiment, an image forming apparatus includes a fixer device with a fixing rotating body to fix a toner image to a medium and a heating member to heat the fixing rotating body. A temperature sensor is positioned to detect a temperature of the fixing rotating body and output a temperature detection result. A heating control circuit is configured to estimate the temperature of the fixing rotating body based on the temperature detection result, a power supply voltage value of a power source, an energization pulse setting for controlling energization of the heating member, a heat capacity of the fixer device, and a heat resistance of the fixer device. The heating control circuit generates an energization pulse for controlling power to be supplied to the heating member based on the estimated temperature and the temperature detection result. A controller is configured to detect a variation in the heat capacity of the fixer device and to supply a correction amount for the heat capacity corresponding to the detected variation to the heating control circuit.

Hereinafter, an image forming apparatus according to certain example embodiments will be described with reference to the drawings.

Figure 1:
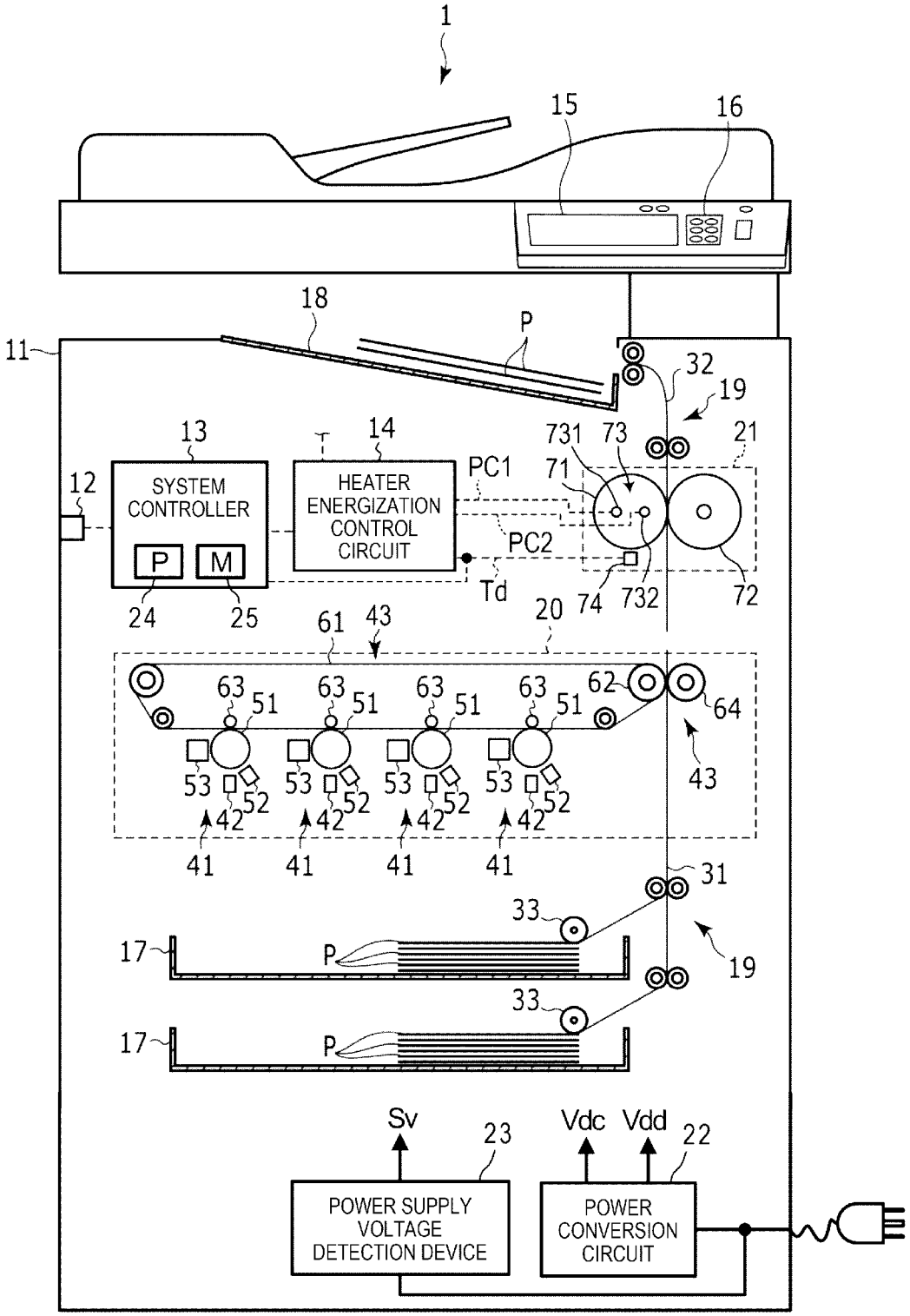
FIG. 1 is a diagram illustrating an example of a configuration of an image forming apparatus according to an embodiment.

FIG. 1 is a diagram illustrating an example of a configuration of an image forming apparatus 1 according to an embodiment.

The image forming apparatus 1 is, for example, a multifunction peripheral (MFP) printer that performs various processes such as image formation while conveying a recording medium such as sheet of paper. Alternatively, the image forming apparatus 1 is, for example, a solid-state scanning printer (for example, an LED printer) that performs scanning with an LED array and performs various processes such as image formation while conveying a recording medium. For example, the image forming apparatus 1 has a configuration in which toner is received from a toner cartridge and an image is formed on a print medium by the toner. The toner may be a single-color toner, or may be color toner such as cyan, magenta, yellow, and black toners. The toner may be a decolorizing toner that decolorizes when heat is applied.

As illustrated in FIG. 1, the image forming apparatus 1 includes a case 11, a communication interface 12, a system controller 13, a heater energization control circuit 14, a display unit 15, an operation interface 16, a plurality of sheet trays 17, a sheet discharge tray 18, a conveyance unit 19, an image forming unit 20, a fixer 21, a power conversion circuit 22, and a power supply voltage detection device 23.

The case 11 is a main body of the image forming apparatus 1. The case 11 houses the communication interface 12, the system controller 13, the heater energization control circuit 14, the display unit 15, the operation interface 16, the plurality of sheet trays 17, the sheet discharge tray 18, the conveyance unit 19, the image forming unit 20, the fixer 21, the power conversion circuit 22, and the power supply voltage detection device 23.

First, a configuration of a control system of the image forming apparatus 1 will be described.

The communication interface 12 is an interface for communicating with other devices. The communication interface 12 is used for communication with an external device such as a user terminal placed in a workplace via, for example, an internal local area network (LAN). In addition, the communication interface 12 can be used, for example, for communication with a host computer via a network or for communication with another image forming apparatus 1 via the internal LAN. The communication interface 12 is, for example, a LAN connector. The communication interface 12 may wirelessly communicate with other devices in accordance with a standard of Bluetooth®, Wi-fi, or the like.

The system controller 13 controls the image forming apparatus 1. The system controller 13 includes, for example, a processor 24 and a memory 25.

The processor 24 is an arithmetic element for calculation. The processor 24 is, for example, a CPU. The processor 24 performs various processes based on data such as a program stored in the memory 25. The processor 24 functions as a control unit capable of executing various operations by executing a program stored in the memory 25.

The memory 25 is a storage medium for storing the program and data or the like used in the program in a non-volatile area. The memory 25 also includes a storage medium for a volatile area that functions as a working memory. That is, the memory 25 temporarily stores, in a volatile area, data being processed by the processor 24, the program to be executed by the processor 24, and the like.

FIG. 2 is a diagram illustrating an example of storage contents in the non-volatile area of the memory 25. The memory 25 stores, for example, a correction amount table 251, a heat capacity correction amount 252, an acquisition flag 253, an acquisition flag set time 254, and the like. The correction amount table 251 stores a heat capacity correction amount according to a temperature difference. The temperature difference value in this context is the difference between a temperature of a heater of the fixer 21 as estimated with the heat capacity correction amount set to "0" by the heater energization control circuit 14 and an actually measured temperature of the heater. The heater energization control circuit 14 controls the heater of the fixer 21 based on the heat capacity of the fixer 21. Therefore, the heater energization control circuit 14 stores in advance a center condition as a design value for a heat capacity of a fixer for each model of the image forming apparatus 1. The heat capacity correction amount in the correction amount table 251 is a correction amount for correcting a variation in heat capacity of fixers of different apparatuses. Therefore, a correlation between the temperature difference and the heat capacity correction amount in the correction amount table 251 is set for each model of the image forming apparatus 1. The heat capacity correction amount 252 is a value of the heat capacity correction amount in the apparatus acquired according to the correction amount table 251. When the temperature is estimated, the heater energization control circuit 14 uses the heat capacity correction amount stored in the heat capacity correction amount 252. The acquisition flag 253 is a flag that is set by the processor 24 when the processor 24 acquires the heat capacity correction amount and stores the acquired heat capacity correction amount in the heat capacity correction amount 252. The acquisition flag set time 254 is a date and time when the processor 24 sets the acquisition flag 253.

The processor 24 processes various information by executing the program stored in the memory 25. For example, the processor 24 generates a print job based on an image obtained from an external device such as a user terminal via the communication interface 12. The processor 24 stores the generated print job in the memory 25.

The print job includes image data showing an image to be formed on a print medium P. The image data may be data for forming an image on one print medium P, or may be data for forming images on a plurality of print media P. The print job further includes information indicating whether the print job is color print or monochrome print. The print job may further include information such as the number of copies to be printed (the number of page sets) and the number of prints per copy (the number of pages).

The processor 24 further generates print control information for controlling operations of the conveyance unit 19, the image forming unit 20, and the fixer 21 based on the generated print job. The print control information includes information indicating a timing for feeding the sheet. The processor 24 transmits the print control information to the heater energization control circuit 14.

The processor 24 functions as a controller (engine controller) that controls the operations of the conveyance unit 19 and the image forming unit 20 by executing the program stored in the memory 25. That is, the processor 24 controls the conveyance of the print medium P by the conveyance unit 19, the image formation on the print medium P by the image forming unit 20, and the like.

The image forming apparatus 1 may include an engine controller separately from the system controller 13. In this case, the engine controller controls the conveyance of the print medium P by the conveyance unit 19, the image formation on the print medium P by the image forming unit 20, and the like. In this case, the system controller 13 supplies the engine controller with information necessary for control in the engine controller.

The power conversion circuit 22 supplies a DC voltage to various configurations in the image forming apparatus 1 by using an AC voltage of an AC power supply AC supplied from a power source. For example, the power conversion circuit 22 supplies a DC voltage Vdd necessary for operations of the processor 24 and the memory 25 to the system controller 13. The power conversion circuit 22 supplies a DC voltage necessary for the image formation to the image forming unit 20. The power conversion circuit 22 supplies a DC voltage necessary for conveyance of the print medium P to the conveyance unit 19. The power conversion circuit 22 supplies a DC power supply voltage Vdc for driving the heater of the fixer 21 to the heater energization control circuit 14.

The power supply voltage detection device 23 detects a voltage value of the AC voltage of the AC power supply AC supplied from the power source, and outputs a power supply voltage detection result Sv. A configuration of the power supply voltage detection device 23 is not particularly limited. The power supply voltage detection device 23 may have any configuration that can detect the power supply voltage value. The power supply voltage detection device 23 may detect a voltage value of the DC power supply voltage Vdc converted by the power conversion circuit 22 instead of the voltage value of the AC voltage of the AC power supply AC supplied from the power source. The power supply voltage detection result Sv output by the power supply voltage detection device 23 is input to the system controller 13. The processor 24 of the system controller 13 stores, in the memory 25, a power supply voltage value indicated by the power supply voltage detection result Sv. Further, the processor 24 can transmit the power supply voltage value to a host computer via a network by the communication interface 12. Therefore, the memory 25 of the system controller 13 stores destination information such as a network address of the host computer in a nonvolatile manner. The processor 24 can also transmit the power supply voltage value of the power supply voltage detection result Sv stored in the memory 25 to another image forming apparatus connected via the internal LAN by the communication interface 12 in response to an inquiry from another image forming apparatus. Alternatively, the processor 24 can similarly transmit the power supply voltage value of the power supply voltage detection result Sv to another image forming apparatus connected to the image forming apparatus 1 via an interface in response to an inquiry from another image forming apparatus.

The heater energization control circuit 14 is a temperature control device (temperature control unit) that controls energization to the heater of the fixer 21. The heater energization control circuit 14 generates energization powers PC1 and PC2 for energizing the heater of the fixer 21 and supplies the energizing powers PC1 and PC2 to the heater of the fixer 21.

The display unit 15 includes a display that displays a screen in accordance with a video signal input from the system controller 13 or a display control unit such as a graphics controller. For example, the display unit 15 displays screens for various settings of the image forming apparatus 1.

The operation interface 16 is connected to an operation member (user input device). The operation interface 16 supplies an operation signal corresponding to an operation of the operation member to the system controller 13. Examples of the operation member include a touch sensor, a numeric keypad, a power key, a sheet feed key, various function keys, or a keyboard. The touch sensor acquires information indicating a designated position within a certain area. Since the touch sensor is configured as a touch panel integrally with the display unit 15, a signal indicating a touched position on a screen displayed on the display unit 15 is input to the system controller 13.

Next, a configuration of a mechanical system of the image forming apparatus 1 will be described.

The plurality of sheet trays 17 are cassettes for housing the print medium P. The sheet trays 17 supply the print medium P from the outside of the case 11. For example, the sheet trays 17 are retractable from the case 11.

The sheet discharge tray 18 is a tray that supports the print medium P discharged from the image forming apparatus 1.

Next, a configuration for conveying the print medium P in the image forming apparatus 1 will be described.

The conveyance unit 19 is a mechanism for conveying the print medium P in the image forming apparatus 1. As illustrated in FIG. 1, the conveyance unit 19 includes a plurality of conveyance paths. For example, the conveyance unit 19 includes a sheet feed conveyance path 31 and a sheet discharge conveyance path 32.

The sheet feed conveyance path 31 and the sheet discharge conveyance path 32 each include a plurality of motors, a plurality of rollers, and a plurality of guides. The plurality of motors rotate a shaft under the control of the system controller 13 to rotate the roller interlocked with rotation of the shaft. The plurality of rollers rotate to move the print medium P. The plurality of guides control a conveyance direction of the print medium P.

The sheet feed conveyance path 31 takes in the print medium P from the sheet trays 17, and supplies the taken-in print medium P to the image forming unit 20. The sheet feed conveyance path 31 includes pick-up rollers 33 corresponding to the sheet trays. The pick-up rollers 33 take in the print medium P of the sheet trays 17 into the sheet feed conveyance path 31.

The sheet discharge conveyance path 32 is a conveyance path for discharging the print medium P formed with an image from the case 11. The print medium P discharged through the sheet discharge conveyance path 32 is held by the sheet discharge tray 18.

Next, the image forming unit 20 will be described.

The image forming unit 20 forms an image on the print medium P. Specifically, the image forming unit 20 forms the image on the print medium P based on the print job generated by the processor 24.

The image forming unit 20 includes a plurality of processing units 41, a plurality of exposure devices 42, and a transfer mechanism 43. The image forming unit 20 includes an exposure device 42 for each of the processing units 41. Since the plurality of processing units 41 and the plurality of exposure devices 42 respectively have the same configurations, one processing unit 41 and one exposure device 42 will be described.

First, the processing unit 41 will be described.

The processing unit 41 forms a toner image. For example, the plurality of processing units 41 are provided for respective types of toner. For example, the plurality of processing units 41 correspond to cyan, magenta, yellow and black color toners, respectively. Specifically, toner cartridges having toners of different colors are connected to the corresponding processing units 41.

Each toner cartridge includes a toner container and a toner delivery mechanism. The toner container is a container that houses a toner. The toner delivery mechanism is a mechanism including a screw or the like that delivers the toner housed in the toner container.

The processing unit 41 includes a photosensitive drum 51, a charging charger 52, and a developing device 53.

The photosensitive drum 51 is a photoreceptor including a cylindrical drum and a photosensitive layer formed on an outer peripheral surface of the drum. The photosensitive drum 51 rotates at a constant speed by a drive mechanism.

The charging charger 52 uniformly charges a surface of the photosensitive drum 51. For example, the charging charger 52 charges the photosensitive drum 51 to a uniform negative electrode potential (contrast potential) by applying a voltage (development bias voltage) to the photosensitive drum 51 using a charging roller. The charging roller rotates with rotation of the photosensitive drum 51 in a state of applying a predetermined pressure to the photosensitive drum 51.

The developing device 53 is a device for adhering a toner to the photosensitive drum 51. The developing device 53 includes a developer container, a stirring mechanism, a developing roller, a doctor blade, an auto toner control (ATC) sensor, and the like.

The developer container receives and houses the toner delivered from the toner cartridge. A carrier is housed in the developer container in advance. The toner delivered from the toner cartridge is stirred with the carrier by the stirring mechanism. By such stirring, the toner and the carrier are mixed to form a developer. The carrier is housed in the developer container during the manufacture of the developing device 53.

The developing roller rotates in the developer container to adhere the developer to a surface of the developing roller. The doctor blade is a member arranged at a predetermined distance from the surface of the developing roller. The doctor blade removes part of the developer adhering to the surface of the rotating developing roller. Accordingly, a layer of the developer having a thickness corresponding to the distance between the doctor blade and the surface of the developing roller is formed on the surface of the developing roller.

The ATC sensor is, for example, a magnetic flux sensor that includes a coil and detects a voltage value generated in the coil. The detected voltage of the ATC sensor changes depending on a density of a magnetic flux from the toner in the developer container. That is, the system controller 13 determines a concentration ratio (toner concentration ratio) of the toner remaining in the developer container to the carrier based on the detected voltage of the ATC sensor. The system controller 13 operates a motor that drives a delivery mechanism of the toner cartridge based on the toner concentration ratio to deliver the toner from the toner cartridge to the developer container of the developing device 53.

Next, the exposure device 42 will be described.

The exposure device 42 includes a plurality of light emitting elements. The exposure device 42 forms a latent image on the photosensitive drum 51 by irradiating the charged photosensitive drum 51 with light from the light emitting elements. The light emitting elements are, for example, light emitting diodes (LEDs). Each of the light emitting elements irradiates one point on the photosensitive drum 51 with light. The plurality of light emitting elements are arranged in a main scanning direction as a direction parallel to a rotation axis of the photosensitive drum 51.

The exposure device 42 forms one line of the latent image on the photosensitive drum 51 by irradiating the photosensitive drum 51 with light by the plurality of light emitting elements arranged in the main scanning direction. Further, the exposure device 42 continuously irradiates the rotating photosensitive drum 51 with light to form a plurality of lines of the latent image.

In the above-described configuration, when the surface of the photosensitive drum 51 that has been charged by the charging charger 52 is irradiated with light from the exposure device 42, an electrostatic latent image is formed. When the layer of the developer formed on the surface of the developing roller is close to the surface of the photosensitive drum 51, the toner contained in the developer adheres to the latent image formed on the surface of the photosensitive drum 51. Accordingly, a toner image is formed on the surface of the photosensitive drum 51.

Next, the transfer mechanism 43 will be described.

The transfer mechanism 43 transfers the toner image formed on the surface of the photosensitive drum 51 to the print medium P.

The transfer mechanism 43 includes, for example, a primary transfer belt 61, a secondary transfer facing roller 62, a plurality of primary transfer rollers 63, and a secondary transfer roller 64.

The primary transfer belt 61 is an endless belt wound around the secondary transfer facing roller 62 and a plurality of winding rollers. The primary transfer belt 61 has an inner surface (inner peripheral surface) in contact with the secondary transfer facing roller 62 and the plurality of winding rollers, and an outer surface (outer peripheral surface) facing the photosensitive drum 51 of the processing unit 41.

The secondary transfer facing roller 62 rotates by a motor. The secondary transfer facing roller 62 rotates to move the primary transfer belt 61 in a predetermined conveyance direction. The plurality of winding rollers are freely rotatable. The plurality of winding rollers rotate in accordance with the movement of the primary transfer belt 61 by the secondary transfer facing roller 62.

The plurality of primary transfer rollers 63 bring the primary transfer belt 61 into contact with the photosensitive drum 51 of the processing unit 41. The plurality of primary transfer rollers 63 correspond to photosensitive drums 51 of the plurality of processing units 41. Specifically, the plurality of primary transfer rollers 63 are provided at positions facing the photosensitive drums 51 of the corresponding processing units 41 with the primary transfer belt 61 interposed therebetween. The primary transfer rollers 63 contact the inner peripheral surface of the primary transfer belt 61 and displace the primary transfer belt 61 toward the photosensitive drums 51. Accordingly, the primary transfer rollers 63 bring the outer peripheral surface of the primary transfer belt 61 into contact with the photosensitive drums 51.

The secondary transfer roller 64 is provided at a position facing the primary transfer belt 61. The secondary transfer roller 64 contacts the outer peripheral surface of the primary transfer belt 61 and applies pressure. This forms a transfer nip in which the secondary transfer roller 64 and the outer peripheral surface of the primary transfer belt 61 are in close contact with each other. When the print medium P passes through the transfer nip, the secondary transfer roller 64 presses the print medium P passing through the transfer nip against the outer peripheral surface of the primary transfer belt 61.

The secondary transfer roller 64 and the secondary transfer facing roller 62 rotate to convey the print medium P supplied from the sheet feed conveyance path 31 while sandwiching the print medium P therebetween. Accordingly, the print medium P passes through the transfer nip.

When the outer peripheral surface of the primary transfer belt 61 comes into contact with the photosensitive drum 51, the toner image formed on the surface of the photosensitive drum is transferred to the outer peripheral surface of the primary transfer belt 61. If the image forming unit 20 includes the plurality of processing units 41, the primary transfer belt 61 receives toner images from the photosensitive drums 51 of these plurality of processing units 41. The toner images transferred to the outer peripheral surface of the primary transfer belt 61 are conveyed by the primary transfer belt 61 to the transfer nip at which the secondary transfer roller 64 and the outer peripheral surface of the primary transfer belt 61 are in close contact with each other. When the print medium P is present in the transfer nip, the toner image(s) transferred to the outer peripheral surface of the primary transfer belt 61 are transferred to the print medium P in the transfer nip.

Next, a configuration related to the fixing of the image forming apparatus 1 will be described.

The fixer 21 fixes the toner images on the print medium P to which the toner images are transferred. The fixer 21 operates under the control of the system controller 13 and the heater energization control circuit 14. The fixer 21 includes a fixing rotating body, a pressing member, and a heating member. The fixing rotating body is, for example, a heated roller 71. The pressing member is, for example, a press roller 72. The heating member is, for example, a heater 73 that heats the heated roller 71. The fixer 21 further includes a temperature sensor 74 (thermal sensor) that detects a temperature of a surface of the heated roller 71.

Figure 3:
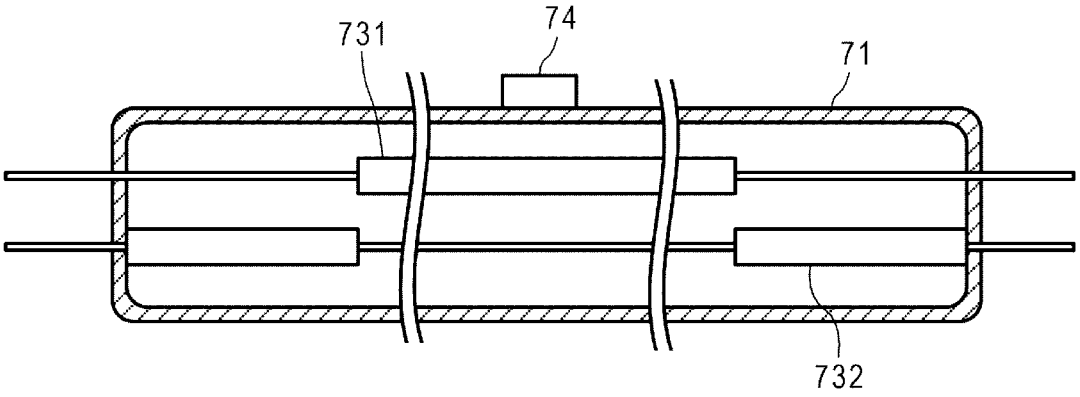
FIG. 3 is a cross-sectional view illustrating an example of a heated roller in a fixing unit.

FIG. 3 is a cross-sectional view illustrating an example of the heated roller 71 in a fixing unit in FIG. 1. The heated roller 71 is a fixing rotating body that rotates by a motor. The heated roller 71 includes a core metal formed of metal in a hollow shape and an elastic layer formed on an outer periphery of the core metal. A diameter of the heated roller 71 is, for example, y 30 mm. The core metal is made of, for example, aluminum having a thickness of 0.6 mm. A peripheral speed of the heated roller 71 is, for example, 210 mm/s. The elastic layer is made of, for example, a fluororesin (tetrafluoroethylene resin). The specified diameter of the heated roller 71, the thickness of the core metal, the value of the peripheral speed of the heated roller 71, and the named materials for the core metal and the elastic layer are non-limiting examples. In the heated roller 71, the inside of the core metal is heated by the heater 73 arranged inside the core metal formed in a hollow shape. The heat generated inside the core metal is transferred to the surface of the heated roller 71 located on the outside (that is, the surface of the elastic layer). The fixing rotating body may be an endless belt.

The press roller 72 is provided at a position facing the heated roller 71. The press roller 72 includes a core metal formed of metal having a predetermined outer diameter, and an elastic layer formed on an outer periphery of the core metal. A diameter of the press roller 72 is, for example, φ 30 mm. The elastic layer of the press roller 72 is made of, for example, silicon rubber or fluorine rubber. The press roller 72 applies pressure to the heated roller 71 due to a force applied from a tension member. The pressure is, for example, 150 N. The specified diameter and the pressure value of the press roller 72 and the materials named are non-limiting examples. The press roller 72 applies the pressure to the heated roller 71 to form a nip (fixing nip) in which the press roller 72 and the heated roller 71 are in close contact with each other. The press roller 72 rotates by a motor. The press roller 72 rotates to move the print medium P that entered the fixing nip and presses the print medium P against the heated roller 71. The heated roller 71 and the press roller 72 may each have a release layer on the respective surfaces.

The heater 73 is a device that generates heat by the energization powers PC1 and PC2 supplied from the heater energization control circuit 14. The heater 73 is a halogen lamp heater including two heater lamps, for example, halogen lamps, as a heating source. That is, the heated roller 71 includes two divided heater lamps, that is, a center heater lamp 731 that heats a central portion and a side heater lamp 732 that heats a peripheral portion. The heater 73 generates heat inside the core metal of the heated roller 71 by electromagnetic waves radiated from the heater lamps 731 and 732, which are the heat sources, when the heater lamps 731 and 732 are energized by the energization powers PC1 and PC2 supplied from the heater energization control circuit 14. A power consumption of each of the heater lamps 731 and 732 is 600 W. For example, when a print medium P having a narrow width is to be fixed, the heater energization control circuit 14 operates only the center heater lamp 731 which heats the central portion of the heated roller 71, but does not operate the side heater lamp 732 which heats the peripheral portion. The power consumption at this time is about 600 W. In contrast, when a print medium P having a wide width such as A4 is to be fixed, the heater energization control circuit 14 operates the center heater lamp 731, and further operates the side heater lamp 732. Therefore, the power consumption at this time is about 1200 W. The heater 73 may be, for example, an IH heater, a planar heater made of ceramic or stainless steel (SUS), or the like.

The temperature sensor 74 detects a temperature of air on or near the surface of the heated roller 71. Although only one temperature sensor 74 is illustrated in FIGS. 1 and 3, a plurality of temperature sensors 74 may be provided. For example, the plurality of temperature sensors 74 may be arranged in parallel with a rotation axis of the heated roller 71. The temperature sensors 74 may be provided at positions where at least a change in the temperature of the heated roller 71 can be detected. The temperature sensor 74 supplies a temperature detection result signal indicating a temperature detection result Td to the heater energization control circuit 14. In the case where a plurality of temperature sensors 74 are provided, for example, when only the center heater lamp 731 is operated, the heater energization control circuit 14 uses an average value of the temperature detection results Td of one or more temperature sensors 74 arranged in the central portion of the heated roller 71. When both the center heater lamp 731 and the side heater lamp 732 are operated, the heater energization control circuit 14 uses an average value of the temperature detection results Td of the temperature sensors 74 arranged in the central portion and the side portion or all of the temperature sensors 74.

With the above-described configuration, the heated roller 71 and the press roller 72 apply heat and pressure to the print medium P passing through the fixing nip. The toner on the print medium P is melted by the heat applied from the heated roller 71, and is fused to the surface of the print medium P by the pressure applied by the heated roller 71 and the press roller 72. Accordingly, the toner image is fixed on the print medium P passing through the fixing nip. The print medium P passing through the fixing nip is introduced into the sheet discharge conveyance path 32 and discharged to the outside of the case 11.

Next, the heater energization control circuit 14 will be described.

The heater energization control circuit 14 controls energization to the heater 73 of the fixer 21. The heater energization control circuit 14 generates energization powers PC1 and PC2 for energizing the heater 73 of the fixer 21 and supplies the energizing powers PC1 and PC2 to the heater 73 of the fixer 21.

Figure 4:
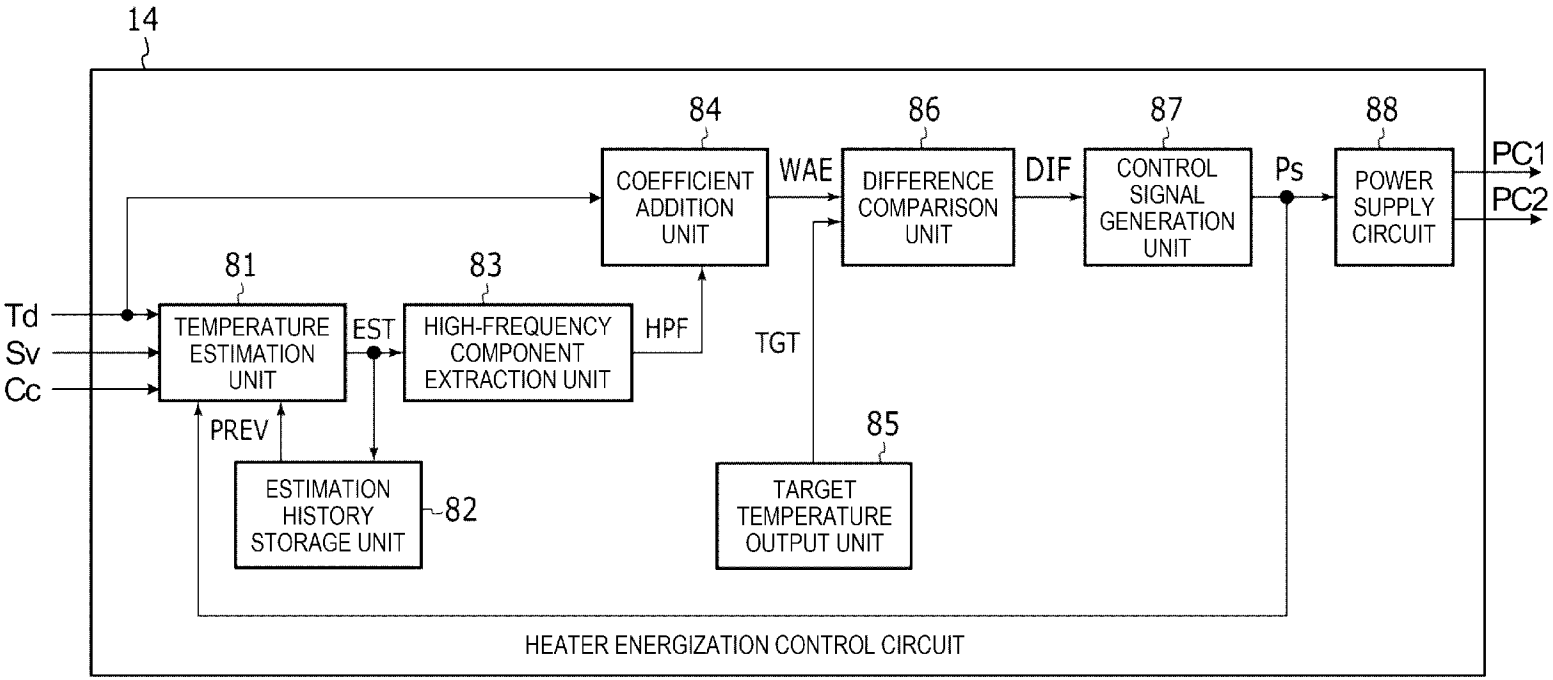
FIG. 4 is a diagram illustrating an example of a heater energization control circuit.

FIG. 4 is a diagram illustrating an example of a configuration of the heater energization control circuit 14.

The heater energization control circuit 14 includes a temperature estimation unit 81, an estimation history storage unit 82, a high-frequency component extraction unit 83, a coefficient addition unit 84, a target temperature output unit 85, a difference comparison unit 86, a control signal generation unit 87, and a power supply circuit 88. The temperature detection result Td from the temperature sensor 74 and the power supply voltage detection result Sv stored in the memory 25 of the system controller 13 are input to the heater energization control circuit 14. Further, a heat capacity correction amount Cc from the processor 24 of the system controller 13 is also input to the heater energization control circuit 14. As the heat capacity correction amount Cc, "0" or a value stored in the heat capacity correction amount 252 of the memory 25 is input selectively.

The temperature estimation unit 81 performs temperature estimation of estimating the temperature of the surface of the heated roller 71. The temperature detection result Td from the temperature sensor 74, the power supply voltage detection result Sv and the heat capacity correction amount Cc from the system controller 13, an estimation history PREV from the estimation history storage unit 82, and an energization pulse Ps from the control signal generation unit 87 are input to the temperature estimation unit 81. The temperature estimation unit 81 estimates an amount of heat given to the heated roller 71 based on a RC circuit in which a value of each element is set in advance based on an amount of power supplied to the heater 73, a heat capacity of the heated roller 71, and the like. At this time, the temperature estimation unit 81 performs correction by the input heat capacity correction amount Cc. The temperature estimation unit 81 generates a temperature estimation result EST based on the estimated amount of heat given to the heated roller 71, the input temperature detection result Td, the power supply voltage detection result Sv, the estimation history PREV, and the energization pulse Ps. The temperature estimation unit 81 outputs the temperature estimation result EST to the estimation history storage unit 82 and the high-frequency component extraction unit 83.

The estimation history storage unit 82 holds a history of the temperature estimation result EST. The estimation history storage unit 82 outputs the estimation history PREV, which is the history of the temperature estimation result EST (past temperature estimation result EST), to the temperature estimation unit 81.

The high-frequency component extraction unit 83 performs high pass filtering of extracting a high-frequency component of the temperature estimation result EST. The high-frequency component extraction unit 83 outputs a high-frequency component HPF, which is a signal indicating the extracted high-frequency component, to the coefficient addition unit 84.

The coefficient addition unit 84 performs coefficient addition, which is correction of the temperature detection result Td. The temperature detection result Td from the temperature sensor 74 and the high-frequency component HPF from the high-frequency component extraction unit 83 are input to the coefficient addition unit 84. The coefficient addition unit 84 corrects the temperature detection result Td based on the high-frequency component HPF. Specifically, the coefficient addition unit 84 multiplies the high-frequency component HPF by a preset coefficient, and adds the result to the temperature detection result Td to calculate a corrected temperature value WAE. The coefficient addition unit 84 outputs the corrected temperature value WAE to the difference comparison unit 86. Although not particularly illustrated, the coefficient addition unit 84 also outputs the corrected temperature value WAE to the processor 24.

The target temperature output unit 85 outputs a preset target temperature TGT to the difference comparison unit 86.

The difference comparison unit 86 performs difference calculation. The difference comparison unit 86 calculates a difference DIF between the target temperature TGT from the target temperature output unit 85 and the corrected temperature value WAE from the coefficient addition unit 84, and outputs the difference DIF to the control signal generation unit 87.

The control signal generation unit 87 generates the energization pulse Ps, which is a pulse signal for controlling energization to the heater 73, based on the difference DIF. The control signal generation unit 87 outputs the energization pulse Ps to the power supply circuit 88 and the temperature estimation unit 81.

The power supply circuit 88 supplies the energization powers PC1 and PC2 to the heater 73 based on the energization pulse Ps. The power supply circuit 88 energizes the heater 73 of the fixer 21 using the DC power supply voltage Vdc supplied from the power conversion circuit 22. For example, the power supply circuit 88 supplies the energization powers PC1 and PC2 to the heater 73 by switching between a state in which the DC power supply voltage Vdc from the power conversion circuit 22 is supplied to the heater 73 and a state in which the DC power supply voltage Vdc is not supplied to the heater 73, based on the energization pulse Ps. That is, the power supply circuit 88 varies an energization time to the heater 73 of the fixer 21 in accordance with the energization pulse Ps. Although not particularly illustrated, a lighting control signal according to a size of the print medium P to be fixed is input to the power supply circuit 88 from the processor 24 of the system controller 13. Based on the lighting control signal, that is, according to the size of the print medium P, the power supply circuit 88 supplies only the energization power PC1 or supplies both the energization power PC1 and PC2 to the heater 73.

The power supply circuit 88 may be integrated with the fixer 21. That is, the heater energization control circuit 14 may be configured to supply the energization pulse Ps to a power supply circuit of the heater 73 of the fixer 21 instead of supplying the energization power PC to the heater 73.

As described above, the heater energization control circuit 14 adjusts the amount of power supplied to the heater 73 of the fixer 21 based on the heat capacity correction amount Cc, the temperature detection result Td, the power supply voltage detection result Sv, the temperature estimation history PREV, and the energization pulse Ps. Accordingly, the heater energization control circuit 14 controls a surface temperature of the heated roller 71 heated by the heater 73. Such control is referred to as WAE control. Each of the temperature estimation unit 81, the estimation history storage unit 82, the high-frequency component extraction unit 83, the coefficient addition unit 84, the target temperature output unit 85, the difference comparison unit 86, and the control signal generation unit 87 of the heater energization control circuit 14 may be implemented by an electric circuit or may be implemented by software.

Hereinafter, operations of the image forming apparatus 1 in an image forming system will be described in detail.

Figure 5:
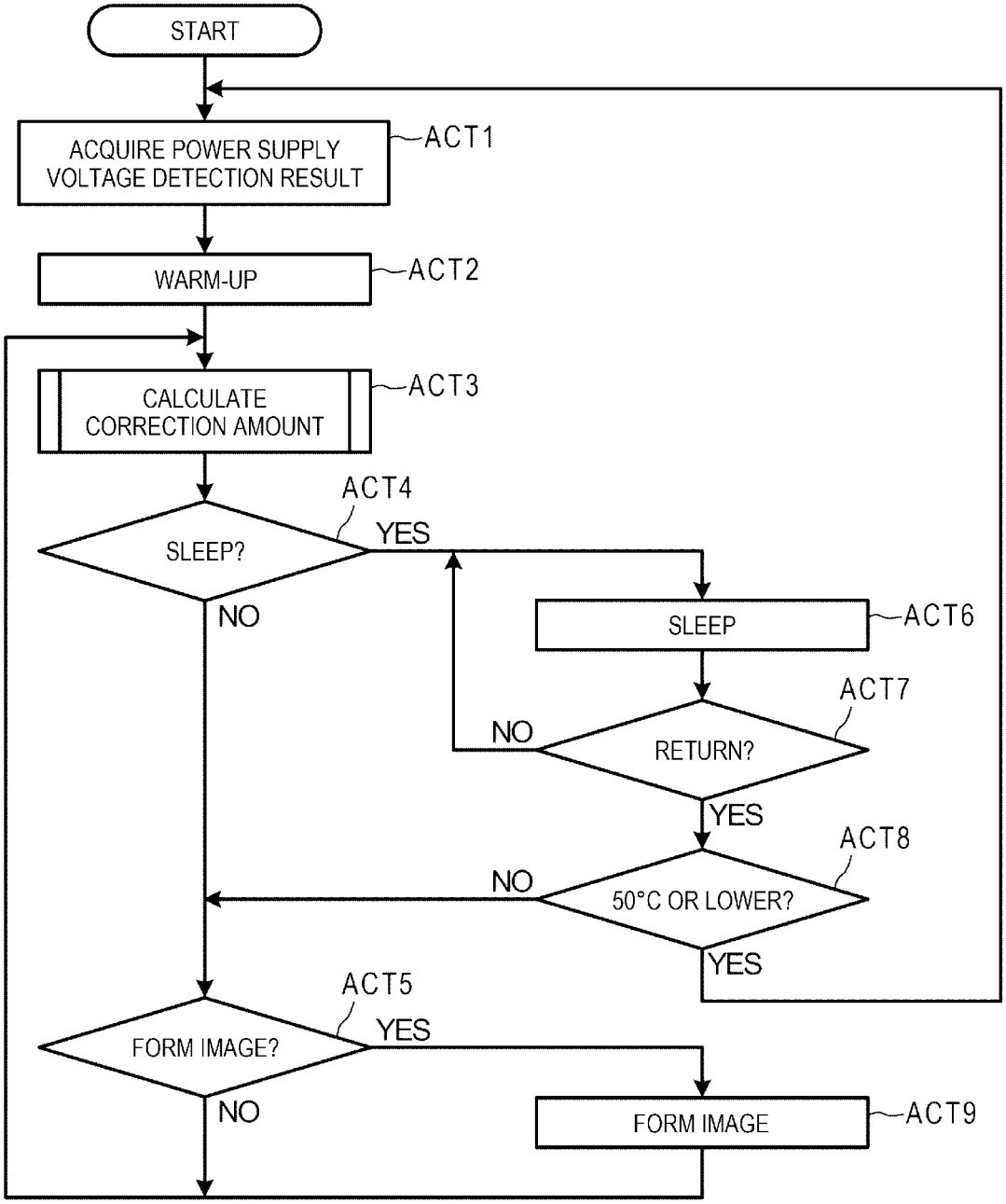
FIG. 5 is a flowchart of operations of an image forming apparatus.

FIG. 5 is a flowchart illustrating an example of operations of the image forming apparatus 1. When the power of the image forming apparatus 1 is turned on, the processor 24 of the system controller 13 of the image forming apparatus 1 executes the program stored in the memory 25 to perform the operations illustrated in the flowchart.

First, the processor 24 acquires the power supply voltage detection result Sv input from the power supply voltage detection device 23 and stores the power supply voltage detection result Sv in a volatile area of the memory 25 (ACT 1).

Thereafter, the processor 24 performs a warm-up operation of raising the surface temperature of the heated roller 71 of the fixer 21, which requires a high temperature during an image formation operation, to a predetermined control temperature, for example, 180° C. (ACT 2). During the warm-up operation, the heater energization control circuit 14 performs the WAE control based on the power supply voltage detection result Sv. At this time, the processor 24 inputs, for example, the correction amount stored in a non-volatile manner in the heat capacity correction amount 252 of the memory 25 to the heater energization control circuit 14 as the heat capacity correction amount Cc. The heater energization control circuit 14 performs the WAE control based on the heat capacity correction amount Cc. After the warm-up operation is ended, the heater energization control circuit 14 also controls the heater 73 so that the surface temperature of the heated roller 71 is maintained at the predetermined control temperature.

When the warm-up operation is ended, the processor 24 performs correction amount calculation (ACT 3). In the correction amount calculation, the heat capacity correction amount Cc is calculated once a day, for example.

When the correction amount calculation is ended, the processor 24 determines whether to enter a sleep state (ACT 4). For example, when the processor 24 did not receive an image formation instruction from an external device such as a user terminal via the operation interface 16 or the communication interface 12 for a predetermined time, the processor 24 determines to proceed to the sleep state. When determining not to enter the sleep state (No in ACT 4), the processor 24 determines whether an image formation instruction is received (ACT 5). When determining that no image formation instruction is received (NO in ACT 5), the processor 24 proceeds to the process in ACT 3.

When determining to enter the sleep state (YES in ACT 4), the processor 24 proceeds to the sleep state (ACT 6). In the sleep state, in order to reduce the power consumption, the display of the display unit 15 is turned off, and the energization to the heater 73 by the heater energization control circuit 14 is ended. When the energization to the heater 73 is ended, the surface temperature of the heated roller 71 decreases gradually.

After that, the processor 24 determines whether to return from the sleep state to a normal state (ACT 7). For example, when receiving a certain instruction from an external device such as a user terminal via the operation interface 16 or the communication interface 12, the processor 24 determines to return to the normal state. When determining not to return to the normal state (NO in ACT 7), the processor 24 proceeds to the process in ACT 6.

When determining to return to the normal state (YES in ACT 7), the processor 24 determines whether the fixer 21 is cooled down at that time. That is, the processor 24 determines whether the surface temperature of the heated roller 71 is a specified temperature, for example, 50° C. or lower based on the temperature detection result Td from the temperature sensor 74 (ACT 8). When determining that the surface temperature of the heated roller 71 is 50° C. or lower (YES in ACT 8), the processor 24 proceeds to the process in ACT 1. In contrast, when determining that the surface temperature of the heated roller 71 is not 50° C. or lower (NO in ACT 8), the processor 24 proceeds to the process in ACT 5.

When determining that the image formation instruction is received (YES in ACT 5), the processor 24 executes an image formation operation (ACT 9). During the image formation operation, the heater energization control circuit 14 performs the WAE control based on the power supply voltage detection result Sv and the heat capacity correction amount Cc. After the image formation operation is ended, the processor 24 proceeds to the process in ACT 3.

Next, the WAE control performed by the heater energization control circuit 14 during the warm-up operation and the image formation operation will be described in detail.

Figure 6:
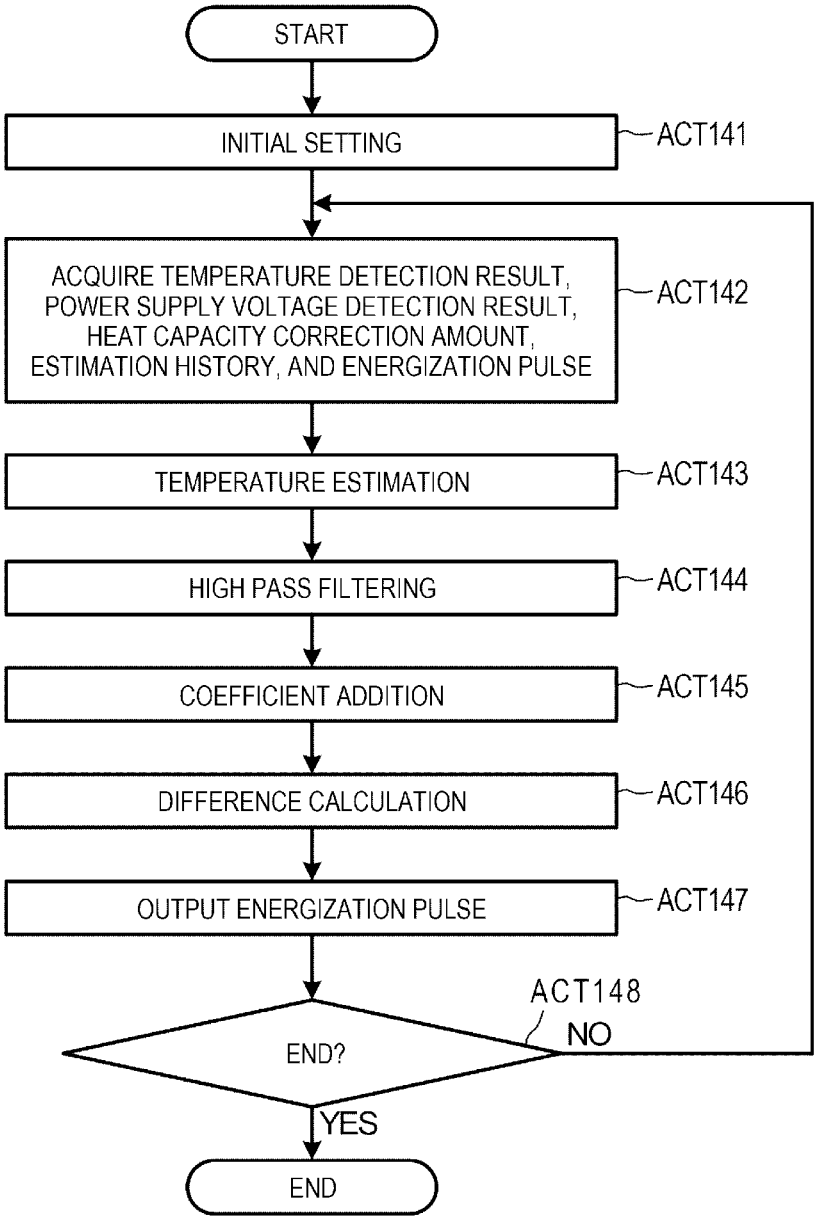
FIG. 6 illustrates a flowchart of operations of a heater energization control circuit.
Figure 7:
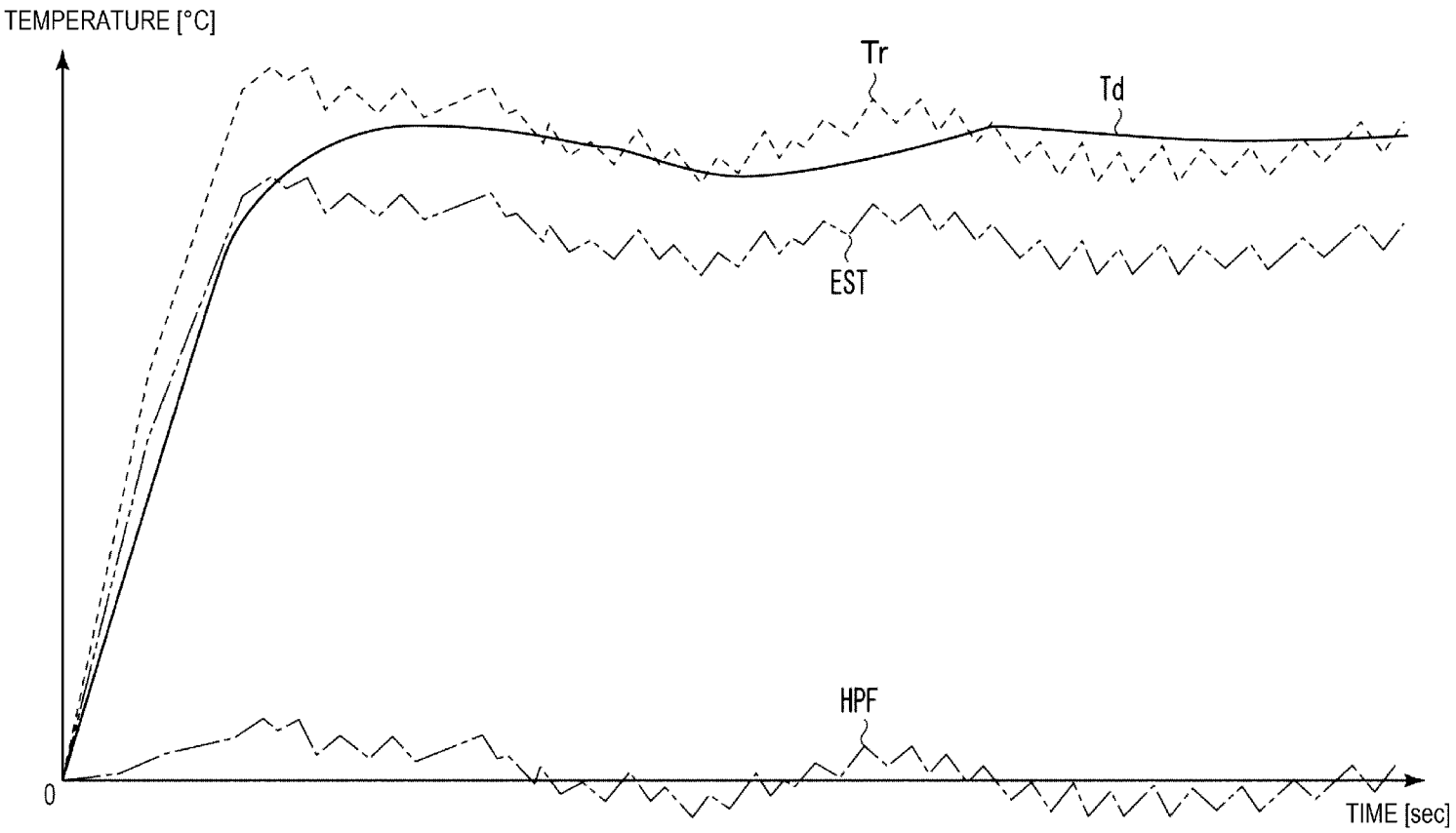
FIG. 7 is a diagram illustrating an example of a surface temperature, a temperature detection result, a temperature estimation result, and a high-frequency component of the temperature estimation result for the heated roller in WAE control.
Figure 8:
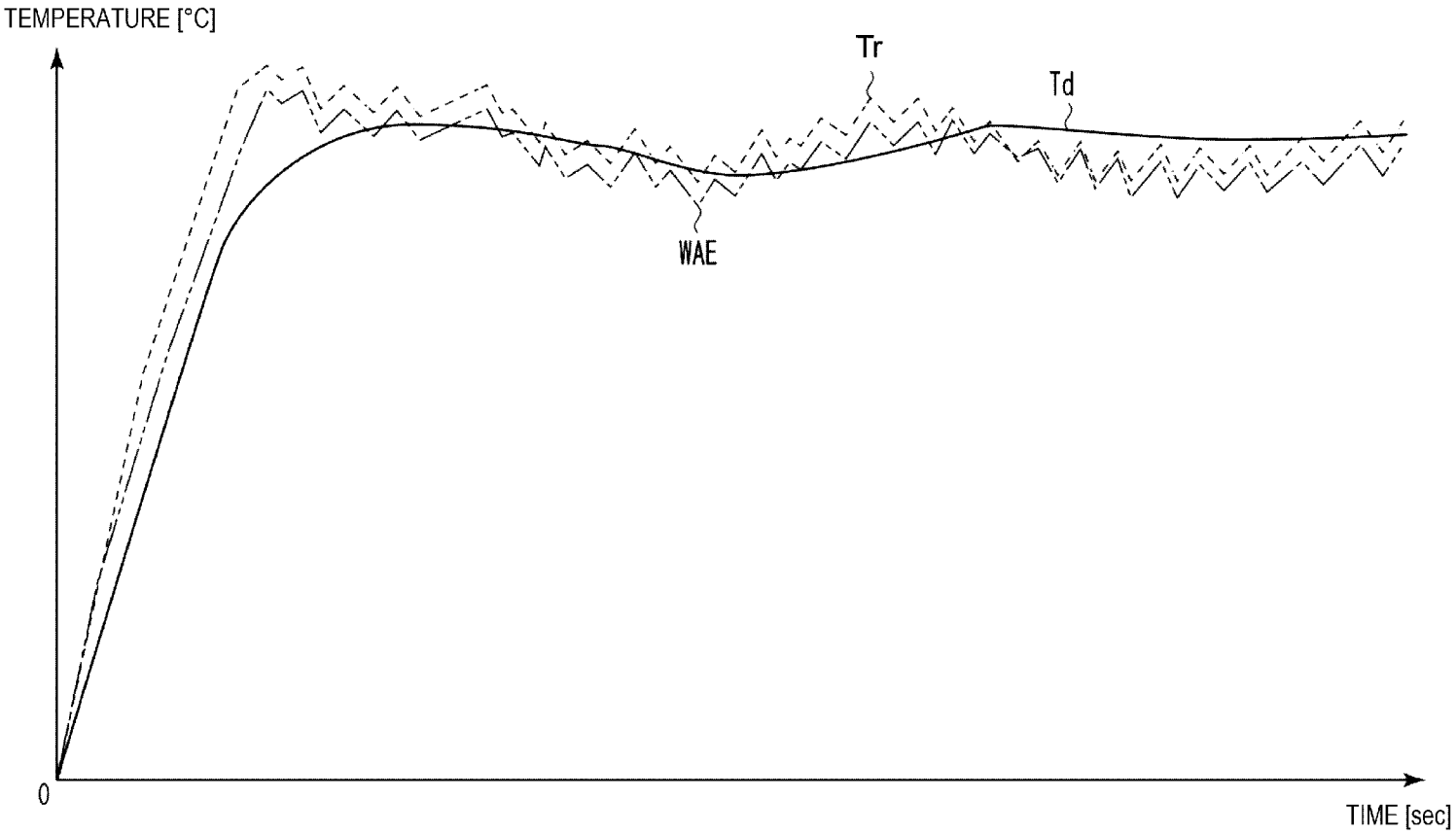
FIG. 8 is a diagram illustrating an example of the surface temperature, the temperature detection result, and a corrected temperature value.

FIG. 6 illustrates a flowchart illustrating an example of operations of the heater energization control circuit 14. FIG. 7 is a diagram illustrating an example of a surface temperature Tr of the heated roller 71, the temperature detection result Td, the temperature estimation result EST, and the high-frequency component HPF of the temperature estimation result EST in the WAE control. FIG. 8 is a diagram illustrating an example of the surface temperature Tr of the heated roller 71, the temperature detection result Td, and the corrected temperature value WAE. A horizontal axis in FIGS. 7 and 8 indicates time, and a vertical axis indicates temperature.

First, the heater energization control circuit 14 sets various initial values (ACT 141). For example, the heater energization control circuit 14 sets a coefficient in the coefficient addition unit 84, the target temperature TGT of the target temperature output unit 85, and the like based on a signal from the system controller 13.

The temperature estimation unit 81 of the heater energization control circuit 14 acquires the temperature detection result Td from the temperature sensor 74, the power supply voltage detection result Sv and the heat capacity correction amount Cc from the system controller 13, the estimation history PREV from the estimation history storage unit 82, and the energization pulse Ps from the control signal generation unit 87 (ACT 142).

As illustrated in FIG. 7, the temperature detection result Td and the actual surface temperature Tr of the heated roller 71 have a difference therebetween. Since the heater 73 intermittently heats the heated roller 71 with short interval pulses or the like, the surface temperature of the heated roller 71 varies with corresponding fine periodicity (high frequency). In contrast, the temperature sensor 74 may have a relatively poor responsiveness to temperature changes due to its heat capacity or other characteristics of the temperature-sensitive material in the temperature sensor 74. In particular, cheaper temperature sensors tend to have poorer responsiveness. As a result, the temperature detection result Td cannot accurately track the actual surface temperature Tr of the heat roller 71. That is, the temperature detection result Td as detected by the temperature sensor 74 is generally delayed with respect to the surface temperature Tr of the heat roller 71. The temperature detection result Td output by the temperature sensor 74 is thus smoothed relative to the actual surface temperature Tr since fine changes in the surface temperature Tr of the heated roller 71 are not reproduced in the output detection result.

The temperature estimation unit 81 performs the temperature estimation (ACT 143). That is, the temperature estimation unit 81 generates the temperature estimation result EST based on the temperature detection result Td, the power supply voltage detection result Sv, the heat capacity correction amount Cc, the estimation history PREV, and the energization pulse Ps. The temperature estimation unit 81 outputs the temperature estimation result EST to the high-frequency component extraction unit 83 and the estimation history storage unit 82.

Movement of heat can be expressed equivalently by a RC time constant of an electric circuit. A heat capacity of the fixer is replaced with a capacitor C. A resistance of heat transfer is replaced with a resistor R. A heat source can be replaced with a DC voltage source. The temperature estimation unit 81 estimates the amount of heat given to the heated roller 71 based on the RC circuit in which the value of each element is set in advance based on the amount of power supplied to the heater 73, the heat capacity of the heated roller 71, and the like. At this time, the temperature estimation unit 81 corrects, using the obtained heat capacity correction amount Cc, the value of the heat capacity C of the fixer preset for each model or type of the image forming apparatus 1, and estimates an amount of heat given to the heated roller 71. The temperature estimation unit 81 estimates the surface temperature of the heated roller 71 based on the amount of heat given to the heated roller 71, the temperature detection result Td, and the estimation history PREV, and outputs the temperature estimation result EST.

In the temperature estimation unit 81, energization/interruption from the DC voltage source is repeated based on the energization pulse Ps, and the RC circuit operates in accordance with the input voltage pulse to generate an output voltage. Accordingly, the heat propagated to the surface of the heated roller 71 to be controlled can be estimated.

The heat of the heated roller 71 flows out to an external environment through a space inside the fixer 21 (outside the heated roller 71). Therefore, the temperature estimation unit 81 further includes a RC circuit for estimating the outflow of heat from the heated roller 71 to the external environment. The temperature estimation unit 81 may further include a RC circuit for estimating an amount of heat flowing from the heated roller 71 to a space in the fixer 21.

As illustrated in FIG. 7, the temperature estimation result EST appropriately tracks a change in the surface temperature Tr of the actual heated roller 71. However, since the temperature estimation result EST is a simulation result, the simulated value may differ from the actual surface temperature Tr of the heated roller 71 due to differences in environmental conditions and the like.

The high-frequency component extraction unit 83 performs high pass filtering of extracting a high-frequency component of the temperature estimation result EST (ACT 144). As illustrated in FIG. 7, the high-frequency component HPF, which is a signal indicating a high-frequency component of the temperature estimation result EST, appropriately tracks a change in the surface temperature Tr of the actual heated roller 71.

The coefficient addition unit 84 performs coefficient addition, which is correction of the temperature detection result Td (ACT 145). The coefficient addition unit 84 multiplies the high-frequency component HPF by a preset coefficient, and adds the high-frequency component HPF multiplied by the coefficient to the temperature detection result Td to calculate a corrected temperature value WAE. That is, the coefficient addition unit 84 adjusts a value of the high-frequency component HPF to be added to the temperature detection result Td with a coefficient to calculate a corrected temperature value WAE.

For example, when the coefficient is "1", the coefficient addition unit 84 directly adds the high-frequency component HPF to the temperature detection result Td. If the coefficient is "0.1", the coefficient addition unit 84 adds a value of 1/10 of the high-frequency component HPF to the temperature detection result Td. In this case, an effect of the high-frequency component HPF is almost eliminated, and the corrected temperature value WAE is thus close to the temperature detection result Td. Experiment shows that the coefficient set in the coefficient addition unit 84 preferably has a value that is near "1" but not "1".

FIG. 8 is a diagram illustrating an example of the actual surface temperature Tr of the heated roller 71, the temperature detection result Td, and the corrected temperature value WAE. In the WAE control, the fine changes in the surface temperature Tr of the heated roller 71 are estimated based on the temperature detection result Td and the high-frequency component HPF of the temperature estimation result EST. Therefore, as illustrated in FIG. 8, the corrected temperature value WAE is a value that may more appropriately track the actual surface temperature of the heated roller 71.

The difference comparison unit 86 calculates the difference DIF between the target temperature TGT from the target temperature output unit 85 and the corrected temperature value WAE from the coefficient addition unit 84, and outputs the calculated difference DIF to the control signal generation unit 87 (ACT 146).

The control signal generation unit 87 generates the energization pulse Ps based on the difference DIF. The control signal generation unit 87 outputs the energization pulse Ps to the power supply circuit 88 and the temperature estimation unit 81 (ACT 147). The power supply circuit 88 supplies the energization power PC to the heater 73 based on the energization pulse Ps.

The difference DIF indicates a correlation between the target temperature TGT and the corrected temperature value WAE. For example, when the corrected temperature value WAE is larger than the target temperature TGT, the amount of power supplied to the heater 73 is reduced and the surface temperature Tr of the heated roller is reduced by performing control such as narrowing a width of the energization pulse Ps or reducing a frequency of the energization pulse Ps. When the corrected temperature value WAE is smaller than the target temperature TGT, the amount of power supplied to the heater 73 is increased and the surface temperature Tr of the heated roller is increased by performing control such as increasing the width of the energization pulse Ps or increasing the frequency of the energization pulse Ps.

According to the difference DIF, it is possible to understand not only vertical correlation between the corrected temperature value WAE and the target temperature TGT, but also any deviation between the corrected temperature value WAE and the target temperature TGT. For example, when an absolute value of the difference DIF is a large value, the deviation between the corrected temperature value WAE and the target temperature TGT is large, so that the control may be changed significantly. If the absolute value of the difference DIF is a small value, the deviation between the corrected temperature value WAE and the target temperature TGT is small, so that the control may be performed gently.

The processor 24 of the system controller 13 determines whether to end the WAE control (ACT 148). When determining to continue the WAE control (NO in ACT 148), the processor 24 proceeds to the process in ACT 14. When determining to end the WAE control (YES in ACT 148), the processor 24 ends the process in FIG. 6.

As described above, when processing a certain cycle (current cycle), the heater energization control circuit 14 performs the WAE control based on values in a previous cycle (the energization pulse Ps and the temperature estimation result EST: the estimation history PREV), and the temperature detection result Td, the power supply voltage detection result Sv, and the heat capacity correction amount Cc in the current cycle. That is, the heater energization control circuit 14 reuses the values in the next cycle. The heater energization control circuit 14 re-performs temperature estimation calculation based on the history of the previous calculation. Therefore, the heater energization control circuit 14 always performs the calculation during the operation. In the heater energization control circuit 14, the calculation result is stored in a memory or the like and reused in the calculation of the next cycle.

Figure 9:
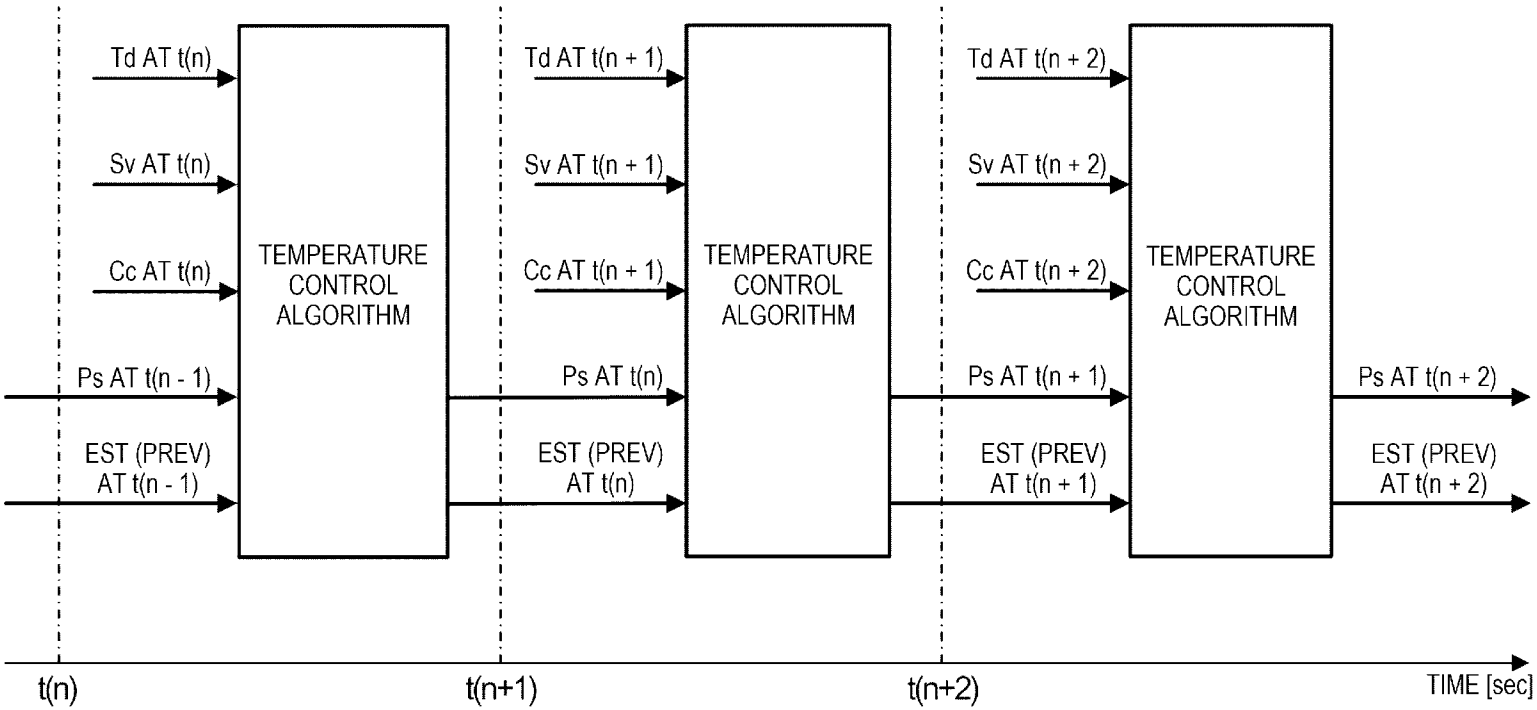
FIG. 9 is a schematic diagram illustrating a processing cycle.

FIG. 9 is a schematic diagram illustrating a processing cycle in the heater energization control circuit 14. The horizontal axis in FIG. 9 indicates time. For example, the temperature estimation unit 81 performs the temperature estimation at a time t(n), performs the next temperature estimation at a time t(n+1) at which the time is advanced by dt, and further performs the temperature estimation at a time t(n+2) at which the time is advanced by dt. Thus, the temperature estimation unit 81 repeatedly performs the temperature estimation. In the temperature estimation of each cycle, the temperature estimation unit 81 uses the previous temperature estimation result EST for new temperature estimation.

At the time t(n), the power supply voltage detection result Sv at the time t(n), the temperature detection result Td at the time t (n), the heat capacity correction amount Cc at the time t(n), the energization pulse Ps at the previous time t(n−1), and the temperature estimation result EST (estimation history PREV) at the previous time t(n−1) are input to the temperature estimation unit 81. The temperature estimation unit 81 performs the process based on the input signal, and outputs the temperature estimation result EST at the time t (n). The high-frequency component extraction unit 83, the coefficient addition unit 84, the difference comparison unit 86, and the control signal generation unit 87 perform the process based on the input signal, and output an energization pulse Ps at the time t(n).

At the time t(n+1), the power supply voltage detection result Sv at the time t(n+1), the temperature detection result Td at the time t(n+1), the heat capacity correction amount Cc at the time t(n+1), the energization pulse Ps at the previous time t (n), and the temperature estimation result EST (estimation history PREV) at the previous time t(n) are input to the temperature estimation unit 81. The temperature estimation unit 81 performs the process based on the input signal, and outputs the temperature estimation result EST at the time t(n+1). The high-frequency component extraction unit 83, the coefficient addition unit 84, the difference comparison unit 86, and the control signal generation unit 87 perform the process based on the input signal, and output the energization pulse Ps at the time t(n+1).

At the time t(n+2), the power supply voltage detection result Sv at the time t(n+2), the temperature detection result Td at the time t(n+2), the heat capacity correction amount Cc at the time t(n+2), the energization pulse Ps at the previous time t(n+1), and the temperature estimation result EST (estimation history PREV) at the previous time t(n+1) are input to the temperature estimation unit 81. The temperature estimation unit 81 performs the process based on the input signal, and outputs the temperature estimation result EST at the time t(n+2). The high-frequency component extraction unit 83, the coefficient addition unit 84, the difference comparison unit 86, and the control signal generation unit 87 perform the process based on the input signal, and output the energization pulse Ps at the time t(n+2).

The above time interval dt may be a fixed value or may be set in initial value setting in ACT 141. For example, the time interval dt is set to 100 [msec].

Figure 10:
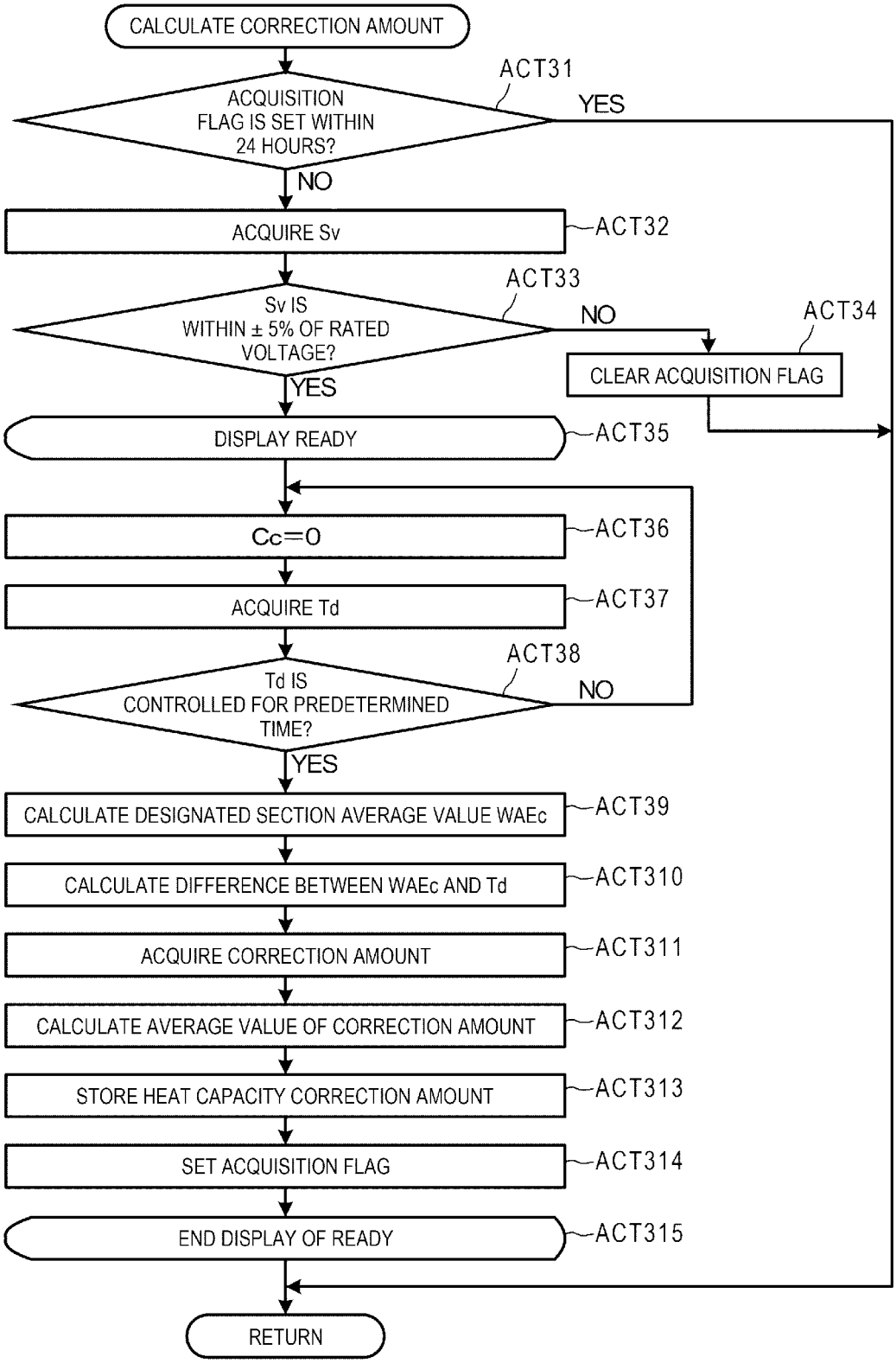
FIG. 10 is a flowchart illustrating an example of correction amount calculation.

Next, the correction amount calculation in ACT 3 will be described. FIG. 10 is a flowchart illustrating an example of the correction amount calculation. The processor 24 of the system controller 13 determines whether the acquisition flag is set within 24 hours before the current date and time tracked by a clock or the like (ACT 31). Specifically, the processor 24 determines whether the content of the acquisition flag 253 of the memory 25 is "1". If the content of the acquisition flag 253 is "1", the processor 24 determines whether the date and time stored as the acquisition flag set time 254 in the memory 25 is earlier than 24 hours before the current date and time. In the present embodiment, as described above, the heat capacity correction amount Cc is calculated once a day. Therefore, here, the processor 24 confirms whether the heat capacity correction amount Cc is calculated within 24 hours.

When the processor 24 determines that the acquisition flag is set within 24 hours before the current date and time (YES in ACT 31), that is, when the heat capacity correction amount Cc is calculated once a day, the processor 24 ends the correction amount calculation illustrated in the flowchart and proceeds to the process in ACT 4. Therefore, as the heat capacity correction amount Cc input to the heater energization control circuit 14 by the processor 24 for the WAE control, a value of the correction amount stored in the heat capacity correction amount 252 of the memory 25 within 24 hours is used continuously.

In contrast, when the processor 24 determines that the acquisition flag is not set within 24 hours before the current date and time (NO in ACT 31), that is, when calculation of the heat capacity correction amount Cc once a day is not performed yet, the processor 24 acquires the power supply voltage detection result Sv (ACT 32). This process may be a process of reading the power supply voltage detection result Sv stored in the volatile area of the memory 25, or may be a process of acquiring the power supply voltage detection result Sv input from the power supply voltage detection device 23.

The processor 24 determines whether the acquired power supply voltage detection result Sv is within a specified voltage value range, for example, within ±5% of a rated voltage (ACT 33). In consideration of a variation in the power supply voltage and the like, ±5% of the rated voltage is set as the specified voltage value range in the present embodiment. When the input power supply voltage greatly deviates from the rated voltage, the influence thereof can also be seen in the WAE estimated value (corrected temperature value WAE) calculated by the heater energization control circuit 14, and it may not always be possible to obtain an accurate correction amount when acquiring the correction amount. Therefore, in the present embodiment, a condition for acquiring a new correction amount is that the specified voltage value range is within ±5% of the rated voltage. Of course, this value of 5% is only an example.

When determining that the power supply voltage detection result Sv is not within ±5% of the rated voltage (NO in ACT 33), the processor 24 clears the acquisition flag (ACT 34). That is, the processor 24 stores "0" in the acquisition flag 253 of the memory 25. After that, the processor 24 ends the correction amount calculation illustrated in this flowchart, and proceeds to the process in ACT 4. Therefore, in this case, the heat capacity correction amount Cc to be input to the heater energization control circuit 14 by the processor 24 for the WAE control is set to a value of the correction amount stored in the heat capacity correction amount 252 of the memory 25 before 24 hours from the current date and time. In some examples, the value of the correction amount stored in the heat capacity correction amount 252 can be an average value of the correction amounts acquired in the past. Therefore, the correction amount stored in the heat capacity correction amount 252 may be converged (stabilized) to some extent after use of the image forming apparatus 1 for a certain number of days, and thus is unlikely to cause a serious problem.

When determining that the power supply voltage detection result Sv is within ±5% of the rated voltage (YES in ACT 33), the processor 24 displays ready on the display unit 15 (ACT 35). That is, since an image cannot be formed on the print medium P during the heat capacity correction amount calculation, the user is notified that the image forming apparatus 1 cannot presently be used.

The processor 24 inputs "0" as the heat capacity correction amount Cc to the temperature estimation unit 81 of the heater energization control circuit 14 (ACT 36). Accordingly, the temperature estimation unit 81 generates the temperature estimation result EST using a heat capacity of the center condition, and the coefficient addition unit 84 of the heater energization control circuit 14 calculates the corrected temperature value WAE. The corrected temperature value WAE is input to the processor 24 as the WAE estimated value estimated by the heater energization control circuit 14. The processor 24 stores the input WAE estimated value in addition to the WAE estimated values accumulated in time series in the work area of the memory 25.

The processor 24 acquires the temperature detection result Td from the temperature sensor 74 (ACT 37). The processor 24 additionally stores the acquired temperature detection result Td with respect to the acquired values already accumulated in time series in the work area of the memory 25.

The processor 24 determines whether the temperature detection result Td is controlled for a predetermined time (ACT 38). Specifically, the processor 24 determines whether a temperature within ±2° C. with respect to a specified print control temperature, for example, 180° C. continues for a predetermined time based on the temperature detection results Td accumulated in time series in the work area of the memory 25. The predetermined time is, for example, 5 seconds. These values (180° C., ±2° C., and 5 seconds) are non-limiting examples. When determining that the temperature detection result Td is not controlled for the predetermined time (NO in ACT 38), the processor 24 proceeds to the process in ACT 36. In this way, the processor 24 waits for the temperature detection result Td to be controlled for the predetermined time.

When determining that the temperature detection result Td is controlled for the predetermined time (YES in ACT 38), the processor 24 calculates a designated section average value WAEc based on the WAE estimated values accumulated in time series in the work area of the memory 25 (ACT 39). The designated section average value WAEc is a WAE estimated value based on the center condition. Therefore, the calculated designated section average value WAEc is hereinafter referred to as a WAE estimated value WAEc. The designated section is, for example, the latest 5 seconds.

The processor 24 calculates a difference between the calculated WAE estimated value WAEc and the latest temperature detection result Td stored in the work area of the memory 25 (ACT 310).

The processor 24 acquires a correction amount corresponding to the calculated difference from the correction amount table 251 of the memory 25 (ACT 311).

Figure 11:
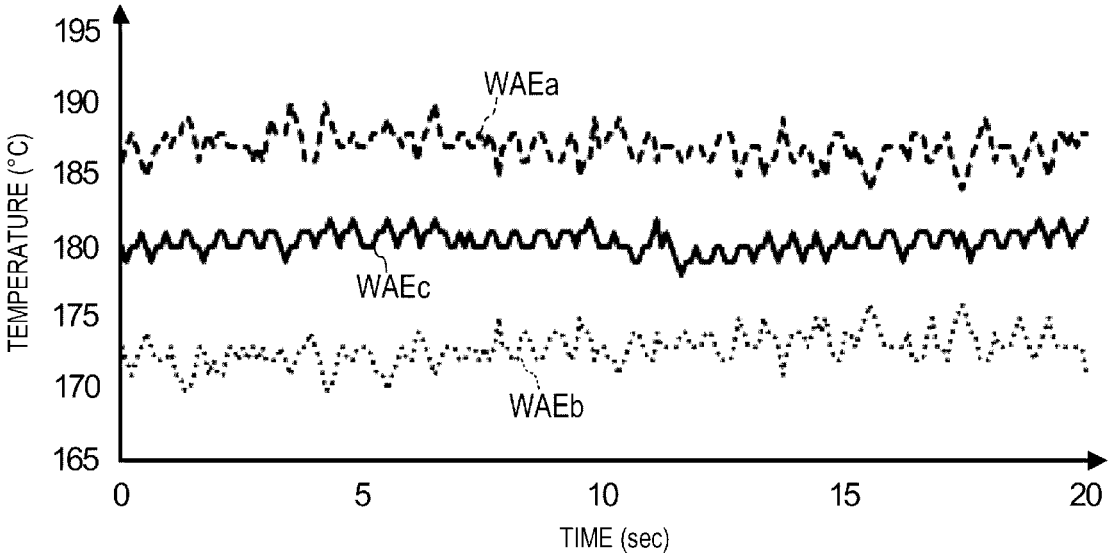
FIG. 11 is a diagram illustrating an influence of variations in a heat capacity of a fixer on WAE estimated values.
Figure 12:
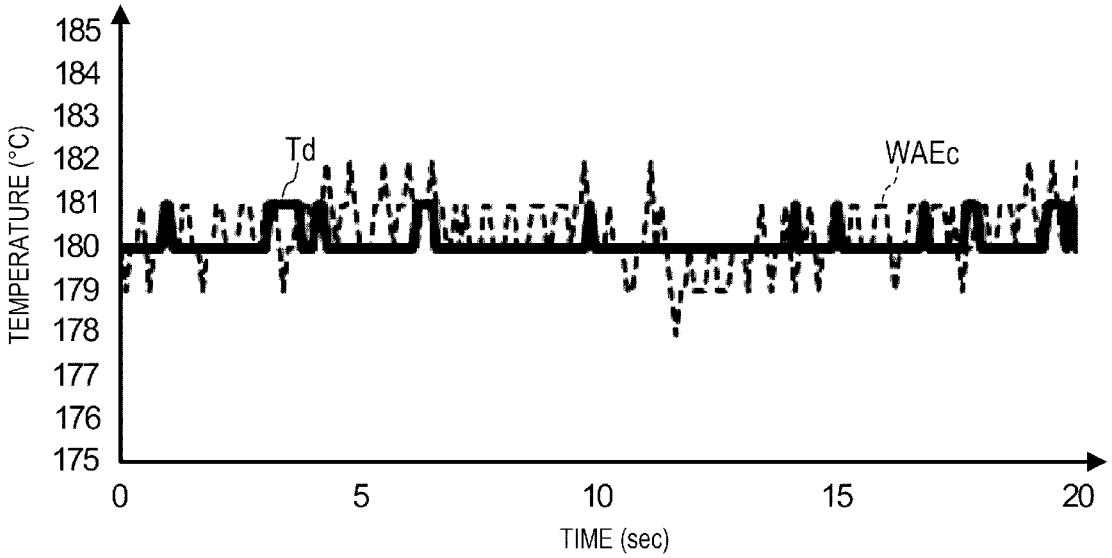
FIG. 12 is a diagram illustrating a correlation between a temperature detection result and a WAE estimated value.

FIG. 11 is a diagram illustrating an influence of a variation in the heat capacity of the fixer on the WAE estimated values. FIG. 12 is a diagram illustrating a correlation between the temperature detection result and the WAE estimated value.

When the heat capacity C of the fixer is as designed without variation, the WAE estimated value WAEc at the time of stable printing (when the heat capacity C of the fixer is controlled within ±2° C. with respect to the print control temperature, for example, 180° C.) changes as illustrated in FIG. 11. As illustrated in FIG. 12, the WAE estimated value WAEc when the heat capacity C of the fixer is the center condition can be controlled within ±2° C. with respect to the temperature detection result Td of the temperature sensor 74.

However, a variation exists in the actual heat capacity C of the fixer of the image forming apparatus 1, specifically, the heat capacity of the heater 73 as a heating member, with respect to the center condition as a design value. For example, when the heat capacity C of the fixer is shifted upward with respect to the center condition, in the WAE estimated value calculated under the center condition of the heat capacity C of the fixer, the input energy for maintaining the control temperature increases in accordance with the increase in the heat capacity C of the fixer. Therefore, as illustrated in FIG. 11, a WAE estimated value WAEa in this case is also larger than the WAE estimated value WAEc under the center condition. In contrast, when the heat capacity C of the fixer is shifted downward with respect to the center condition, in the WAE estimated value calculated under the center condition of the heat capacity C of the fixer, the input energy for maintaining the control temperature decreases in accordance with the decrease in the heat capacity C of the fixer. Therefore, as illustrated in FIG. 11, a WAE estimated value WAEb in this case is also smaller than the WAE estimated value WAEc under the center condition.

From this correlation, in the correction amount table 251, when the difference (Td−WAEc) calculated in the ACT 310 is within ±2° C. (that is, Td−2<WAEc<Td+2) the correction amount is set to "0" (that is, the heat capacity C of the fixer is not corrected/adjusted). When the difference (Td−WAEc) is larger than +2° C. (that is, WAEc<Td−2) the correction amount in the correction amount table 251 is set to a value corresponding to the difference (Td−WAEc) such that the heat capacity C of the fixer is corrected to be smaller. In contrast, when the difference (Td−WAEc) is smaller than −2° C. (that is, Td−2<WAEc) the correction amount in the correction amount table 251 is set to a value corresponding to the difference (Td−WAEc) such that the heat capacity C of the fixer is corrected to be larger. The numerical values of the correction amounts in the correction amount table 251 illustrated in FIG. 2 are values when the values of the heated roller 71, the press roller 72, and the heater 73 are set as described above, and an applied heat amount equivalent Vinpower is set to "12", an input heat resistance R1 is set to "8.1", a heat dissipation resistance R2 during rotation is set to "15.5", a heat dissipation resistance R2s at the time of the stop is set to "50", and the heat capacity C is set to "21". These numerical values of the correction amounts in the correction amount table 251 illustrated in FIG. 2 are only non-limiting examples.

Thus, when the correction amount is acquired, the processor 24 calculates an average value of the acquired correction amount and the value stored in the heat capacity correction amount 252 of the memory 25 (ACT 312). The processor 24 updates and stores the calculated average value as a new heat capacity correction amount in the heat capacity correction amount 252 (ACT 313).

The processor 24 sets the acquisition flag (ACT 314) That is, the processor 24 stores "1" in the acquisition flag 253 of the memory 25, and stores the current date and time tracked by a clock in the acquisition flag set time 254 of the memory 5.

The processor 24 ends displaying ready on the display unit 15 (ACT 315). After that, the processor 24 ends the correction amount calculation illustrated in this flowchart, and proceeds to the process in ACT 4. Therefore, thereafter, the heat capacity correction amount Cc input to the heater energization control circuit 14 by the processor 24 for the WAE control is set to the value updated and stored in the heat capacity correction amount 252 of the memory 25.

In an embodiment, the processor 24 determines whether to perform new heat capacity correction amount calculation based on a determination result of setting the acquisition flag within 24 hours in the ACT 31. However, regardless of the acquisition flag, the new heat capacity correction amount calculation may be performed by setting of a timer or the like such that a new calculation may occur at a specific time, such as 9:00 in the morning.

Instead of performing the new heat capacity correction amount calculation once a day, the processor 24 may perform the new heat capacity correction amount calculation a plurality of times during each day, or conversely, just once over a plurality of days.

In an embodiment, in the determination in ACT 38, the processor 24 determines whether the temperature detection result Td can be controlled for a predetermined time by determining whether a temperature within ±2° C. with respect to a specified print control temperature continues for a predetermined time. Instead of the print control temperature, any specified ready control temperature may be used.

In an embodiment, the correction amount is acquired using the correction amount table 251. In other examples, instead of the correction amount table 251, a formula or function for providing the correction amount based on the different may be stored in the memory 25, and the processor 24 may calculate the correction amount according to the function/formula.

The image forming apparatus 1 in some examples may not include the power supply voltage detection device 23. For example, the power supply voltage detection result Sv can be acquired from another device via the network by the communication interface 12. The processor 24 can also estimate the power supply voltage detection result Sv from, for example, a change in the temperature detection result Td from the temperature sensor 74 during the warm-up operation, that is, a time from a certain temperature to a specified temperature.

As described above, the image forming apparatus 1 includes the fixer 21, the temperature sensor 74, the heater energization control circuit 14, and the processor 24. The fixer 21 includes the heated roller 71 configured to heat a toner image formed on the print medium P to fix the toner image on the print medium P, and the heater 73 configured to heat the heated roller 71. The temperature sensor 74 is configured to detect the temperature of the heated roller 71 to which heat is propagated from the heater 73 and output the temperature detection result Td. The heater energization control circuit 14 is configured to estimate the surface temperature Tr of the heated roller 71 based on the temperature detection result Td, the power supply voltage detection result Sv (as the power supply voltage value of the power source), the energization pulse Ps for controlling the energization to the heater 73, and the heat capacity and the heat resistance values for the fixer 21 that are set in advance, and output the energization pulse Ps for controlling power to be supplied to the heater 73 based on the estimated surface temperature Tr of the heated roller 71 and the temperature detection result Td. The processor 24 of the system controller 13 is configured to detect a variation in the heat capacity of the fixer 21 and provide the heat capacity correction amount Cc for correcting the heat capacity value to compensate for the variation to the heater energization control circuit 14.

According to such a configuration, by correcting the amount of deviation in the estimated value of the surface temperature of the heated roller 71 due to the variation in the heat capacity of the fixer 21 for each image forming apparatus 1 and matching the corrected amount with a condition in accordance with the apparatus, it is possible to obtain a more accurate WAE estimated value to output the energization pulse Ps. Therefore, it is possible to estimate an accurate WAE estimated value in accordance with each apparatus and control the surface temperature of the heated roller 71 to be the target value.

The processor 24 can be configured to determine the correction amount based on a comparison between the temperature detection result Td and the WAE estimated value WAEc as an average value of the temperatures of the heated roller 71 estimated by the heater energization control circuit 14 during the set period. As described above, by using the comparison between the WAE estimated value WAEc and the temperature detection result Td, variation in the heat capacity of the fixer 21 can be easily detected.

The processor 24 can be configured to input "0" as the heat capacity correction amount Cc to the heater energization control circuit 14 during the set period. Accordingly, since the WAE estimated value WAEc is estimated without correcting the heat capacity set in advance, it is possible to detect the variation in the heat capacity of the fixer 21 for each image forming apparatus 1.

The image forming apparatus 1 further includes the memory 25 configured to store the correction amount table 251 (which is a table of the correction amount with respect to the difference between the WAE estimated value WAEc and the temperature detection result Td). The processor 24 is configured to calculate the difference between the WAE estimated value WAEc and the temperature detection result Td and acquire the correction amount corresponding to the calculated difference from the correction amount table 251. Thus, by preparing the correction amount table 251 in advance, it is possible to quickly acquire the correction amount.

The correction amount in the correction amount table 251 is "0" when the calculated difference is within some predetermined temperature range, is a value for correcting the heat capacity of the fixer downward when the difference is above the temperature range, and is a value for correcting the heat capacity of the fixer to be upward when the difference is below the temperature range. Thus, it is possible to determine the necessary correction amount only when necessary.

The correction amount in the correction amount table 251 is a value determined based on a structure, a size, and a material of the fixer 21. That is, the correction amount is determined for each different model or type of the image forming apparatus 1. By preparing the correction amount table 251 according to the model of the image forming apparatus 1 in advance, it is possible to determine the appropriate correction amount in view the specific characteristics of the fixer 21.

The processor 24 can be configured to determine the correction amount once a day. Accordingly, it is possible to reduce the period in which the image forming apparatus 1 cannot be used.

The processor 24 can be configured to determine the correction amount only when the power supply voltage input to the image forming apparatus 1 is within the specified voltage value range with respect to the rated voltage. Accordingly, it is possible to reduce the possibility that an erroneous correction amount is calculated.

The image forming apparatus 1 further includes the heat capacity correction amount 252 of the memory 25 configured to store the correction amount. The processor 24 can be configured to calculate the average value of the determined correction amount and the correction amount stored in the heat capacity correction amount 252, and store the calculated average value as a new correction amount in the heat capacity correction amount 252. Thus, by determining the new correction amount in consideration of the past correction amount, the influence of any erroneous correction amount calculated due to some unexpected situation or random fluctuation can be reduced.

The processor 24 can be configured to determine the correction amount only when the power supply voltage input to the image forming apparatus 1 is within the specified voltage value range with respect to the rated voltage. On the other hand, the processor 24 can be configured to input the correction amount stored in the heat capacity correction amount 252 to the heater energization control circuit 14 when the power supply voltage input to the image forming apparatus 1 is not within the specified voltage value range with respect to the rated voltage. Accordingly, even if the correction amount cannot be determined, it is possible to correct the deviation of the estimated value of the surface temperature of the heated roller 71 due to the variation in the heat capacity of the fixer by using a correction amount determined in the past.

The functions of the above-described embodiments are not limited to being implemented using hardware, and may be implemented by causing a computer to read a program for implementing each function using software. Each function may be implemented by appropriately selecting either software or hardware.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a fixer device including a fixing rotating body to fix a toner image to a medium and a heating member configured to heat the fixing rotating body;

a temperature sensor positioned to detect a temperature of the fixing rotating body and output a temperature detection result;

a heating control circuit configured to:

estimate the temperature of the fixing rotating body based on the temperature detection result, a power supply voltage value of a power source, an energization pulse setting for controlling energization of the heating member, a heat capacity of the fixer device, and a heat resistance of the fixer device, and generate an energization pulse for controlling power to be supplied to the heating member based on the estimated temperature and the temperature detection result; and a controller configured to:

detect a variation in the heat capacity of the fixer device, and supply a correction amount for the heat capacity corresponding to the detected variation to the heating control circuit.

2. The image forming apparatus according to claim 1, wherein the controller is configured to determine the correction amount based on a comparison between the temperature detection result and an average value of the estimated temperature of the fixing rotating body during a set period of time.

3. The image forming apparatus according to claim 2, wherein the controller is configured to set the correction amount to zero during the set period of time.

4. The image forming apparatus according to claim 3, further comprising:

a memory configured to store a table of correction amount values in association with a difference between the temperature detection result and the average value, wherein the controller is configured to calculate the difference, acquire the correction amount value corresponding to the calculated difference from the table, and set the correction amount supplied to the heating control circuit to the acquired correction amount value.

5. The image forming apparatus according to claim 4, wherein the correction amount value listed in the table is:

"0" for values of the difference within a preset range;

a value for correcting the heat capacity of the fixer device to be smaller for values of the difference greater than the preset range; and a value for correcting the heat capacity of the fixer device to be larger for values of the difference is less than the preset range.

6. The image forming apparatus according to claim 5, wherein the correction amount values listed in the table are based on a structure, a size, and a material of the fixer device.

7. The image forming apparatus according to claim 1, wherein the controller is configured to update the correction amount supplied to the heating control circuit once a day.

8. The image forming apparatus according to claim 1, wherein the controller is configured to update the correction amount only if a power supply voltage input to the image forming apparatus is within a specified voltage value range from a rated voltage for the image forming apparatus.

9. The image forming apparatus according to claim 1, further comprising:

a memory configured to store the correction amount supplied to the heating control circuit, wherein the controller is configured to:

determine an updated correction amount based on a comparison between the temperature detection result and an average value of the estimated temperature of the fixing rotating body during a set period of time, calculate an average of the updated correction amount and the correction amount stored in the memory, and supply the calculated average as the correction amount to heating control circuit.

10. The image forming apparatus according to claim 9, wherein the controller is configured to:

determine the updated correction amount only if a power supply voltage input to the image forming apparatus is within a specified voltage value range from a rated voltage for the image forming apparatus.

11. The image forming apparatus according to claim 1, wherein the fixing rotating body is a roller.

12. The image forming apparatus according to claim 1, wherein the heating member is a lamp.

13. The image forming apparatus according to claim 1, further comprising:

a memory configured to store a table of correction amount values in association with a difference between the temperature detection result and the estimated temperature value, wherein the controller is configured to:

determine the correction amount based on a comparison between the temperature detection result and an average value of the estimated temperature of the fixing rotating body during a set period of time; and calculate the difference, acquire the correction amount value corresponding to the calculated difference from the table, and set the correction amount supplied to the heating control circuit to the acquired correction amount value.

14. A fixing device, comprising:

a fixing rotating body to fix a toner image to a medium;

a heating member configured to heat the fixing rotating body;

a temperature sensor positioned to detect a temperature of the fixing rotating body and output a temperature detection result;

a heating control circuit configured to:

estimate the temperature of the fixing rotating body based on the temperature detection result, a power supply voltage value of a power source, an energization pulse setting for controlling energization of the heating member, a heat capacity of the fixer device, and a heat resistance of the fixer device, and generate an energization pulse for controlling power to be supplied to the heating member based on the estimated temperature and the temperature detection result; and a controller configured to:

detect a variation in the heat capacity of the fixer device, and supply a correction amount for the heat capacity corresponding to the detected variation to the heating control circuit.

15. The fixing device according to claim 14, wherein the controller is configured to determine the correction amount based on a comparison between the temperature detection result and an average value of the estimated temperature of the fixing rotating body during a set period of time.

16. The fixing device according to claim 15, further comprising:

a memory configured to store a table of correction amount values in association with a difference between the temperature detection result and the average value, wherein the controller is configured to calculate the difference, acquire the correction amount value corresponding to the calculated difference from the table, and set the correction amount supplied to the heating control circuit to the acquired correction amount value.

17. The fixing device according to claim 14, wherein the fixing rotating body is a roller.

18. The fixing device according to claim 14, wherein the heating member is a lamp.

19. An image forming apparatus, comprising:

a fixer device including heated roller to fix a toner image to a medium and a heating lamp configured to heat the heated roller;

a temperature sensor positioned to detect a surface temperature of the heated roller and output a temperature detection result;

a heating control circuit configured to:

estimate the surface temperature of the heated roller based on the temperature detection result, a power supply voltage value of a power source of the image forming apparatus, an energization pulse setting for controlling energization of the heating lamp, a heat capacity of the fixer device, and a heat resistance of the fixer device, and generate an energization pulse for controlling power to be supplied to the heating lamping based on the estimated temperature and the temperature detection result; and a controller configured to:

detect a variation in the heat capacity of the fixer device, and supply a correction amount for the heat capacity corresponding to the detected variation to the heating control circuit.

20. The image forming apparatus according to claim 19, wherein the controller is configured to determine the correction amount based on a comparison between the temperature detection result and an average value of the estimated temperature of the fixing rotating body during a set period of time.

* * * * *